US007050751B2

(12) United States Patent
Watanabe et al.

(10) Patent No.: US 7,050,751 B2
(45) Date of Patent: May 23, 2006

(54) IMAGE FORMING SYSTEM WITH TEMPORARY STORAGE TRAYS BETWEEN SHEET STORAGE UNITS AND IMAGE FORMING APPARATUS

(75) Inventors: Naoto Watanabe, Chiba (JP); Hitoshi Kato, Ibaragi (JP); Takahiro Watanabe, Chiba (JP); Keita Takahashi, Chiba (JP); Masahiro Serizawa, Ibaragi (JP); Ichiro Sasaki, Ibaragi (JP); Takuya Kawamura, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 135 days.

(21) Appl. No.: 10/890,109

(22) Filed: Jul. 14, 2004

(65) Prior Publication Data

US 2005/0025543 A1 Feb. 3, 2005

(30) Foreign Application Priority Data

Jul. 28, 2003 (JP) ..... 2003-202402
Jul. 28, 2003 (JP) ..... 2003-202403
Jul. 29, 2003 (JP) ..... 2003-202984
Jul. 29, 2003 (JP) ..... 2003-202985
Jul. 29, 2003 (JP) ..... 2003-202986

(51) Int. Cl.
*G03G 15/00* (2006.01)

(52) U.S. Cl. ..... 399/391; 399/393

(58) Field of Classification Search ..... 399/107, 399/110, 391, 393, 401, 381
See application file for complete search history.

(56) References Cited

U.S. PATENT DOCUMENTS 4,268,943 A 5/1981 Watanabe et al. ..... 29/131
4,317,270 A 3/1982 Watanabe et al. ..... 29/447
4,796,035 A 1/1989 Kawasaki et al. ..... 346/108
5,131,079 A * 7/1992 Miyawaki et al. ..... 345/418
5,290,024 A 3/1994 Takahashi ..... 271/122
5,357,329 A 10/1994 Ariyama et al. ..... 355/309
5,407,186 A * 4/1995 Hayama et al. ..... 270/58.13
5,474,287 A 12/1995 Takahashi ..... 271/10.13
5,508,799 A * 4/1996 Irie ..... 399/404
5,532,799 A 7/1996 Watanabe et al. ..... 355/245
5,644,403 A * 7/1997 Watanabe ..... 358/296
5,666,595 A 9/1997 Sameshima et al. ..... 399/110
5,669,040 A * 9/1997 Hisatake ..... 399/83
5,715,506 A 2/1998 Takeuchi et al. ..... 399/303
5,909,872 A 6/1999 Takahashi ..... 271/116
5,915,146 A 6/1999 Kusaka et al. ..... 399/68
6,097,904 A * 8/2000 Tsuruno et al. ..... 399/33
6,179,287 B1 1/2001 Watanabe et al. ..... 271/215
6,240,263 B1 5/2001 Watanabe et al. ..... 399/69
6,293,536 B1 9/2001 Boehmer et al. ..... 271/9.11
6,311,039 B1 10/2001 Funamizu et al. ..... 399/394
6,325,585 B1 12/2001 Sasaki et al. ..... 412/11
6,343,197 B1 1/2002 Serizawa et al. ..... 399/82

(Continued)

FOREIGN PATENT DOCUMENTS

JP 5-53478 3/1993

(Continued)

*Primary Examiner*—Andrew H. Hirshfeld
*Assistant Examiner*—Dave A. Ghatt
(74) *Attorney, Agent, or Firm*—Fitzpatrick, Cella, Harper & Scinto

(57) ABSTRACT

An image forming system has a sheet deck assembly, an image forming apparatus, and a feeding buffering apparatus with plural feeding buffer trays for temporarily storing sheets of printing paper fed from plural printing paper decks of the sheet deck assembly. The feeding buffering apparatus feeds the temporarily stored sheets to the image forming apparatus.

21 Claims, 25 Drawing Sheets

U.S. PATENT DOCUMENTS

| | | | | |
|---|---|---|---|---|
| 6,351,625 | B1 | 2/2002 | Sato et al. | 399/382 |
| 6,397,035 | B1 | 5/2002 | Kataoka et al. | 399/388 |
| 6,546,226 | B1 | 4/2003 | Sato et al. | 399/382 |
| 6,651,980 | B1 | 11/2003 | Isemura et al. | 271/259 |
| 6,654,570 | B1 | 11/2003 | Kato | 399/66 |
| 6,782,236 | B1 | 8/2004 | Sasaki et al. | 399/401 |
| 6,882,823 | B1 * | 4/2005 | Matsuyama et al. | 399/401 |
| 6,980,767 | B1 * | 12/2005 | Cahill et al. | 399/408 |
| 2002/0041780 | A1 | 4/2002 | Sato et al. | 399/382 |
| 2003/0021608 | A1 | 1/2003 | Morita et al. | 399/23 |
| 2003/0044186 | A1 | 3/2003 | Kato et al. | 399/16 |
| 2003/0143011 | A1 | 7/2003 | Yoshikawa et al. | 400/578 |
| 2003/0184010 | A1 | 10/2003 | Kato et al. | 271/207 |
| 2003/0202812 | A1 | 10/2003 | Kawamura | 399/67 |
| 2003/0202829 | A1 | 10/2003 | Sato et al. | 399/382 |
| 2003/0235328 | A1 | 12/2003 | Nakamura et al. | 382/112 |
| 2004/0081478 | A1 | 4/2004 | Kobayashi et al. | 399/69 |
| 2005/0099438 | A1 * | 5/2005 | Lester et al. | 347/4 |
| 2005/0206665 | A1 * | 9/2005 | Kaneko | 347/5 |

FOREIGN PATENT DOCUMENTS

| | | |
|---|---|---|
| JP | 2000-211803 | 8/2000 |
| JP | 2001-506212 | 5/2001 |

* cited by examiner

IMAGE FORMING SYSTEM WITH TEMPORARY STORAGE TRAYS BETWEEN SHEET STORAGE UNITS AND IMAGE FORMING APPARATUS

BACKGROUND OF THE INVENTION

1. Field of the Invention

The present invention relates to an image forming system which performs image forming processing on fed sheets of printing paper and outputting of the imaged sheets.

2. Description of the Related Art

In recent years, a field called "on-demand printing" has attracted attention as a field relating to digital copying machines and printing. On-demand printing can meet a multi-type small-lot demand, and can be used to easily change the printing content. Accordingly, on-demand printing is suitable for use in producing documents, such as manuals, and brochures for individual users. In addition, on-demand printing IS advantageous in that it reduces the number of printed sheets that need to be kept in stock and reduces steps and time during in-line processing from data input to completion of bookbinding. In addition, on-demand printing has a feature in that data transfer is facilitated by using a digital line to establish connection to a client. Therefore, the time to delivery can be considerably reduced and the delivery cost can be reduced.

Technologies relating to on-demand printing include use of an image recording apparatus such as a digital copying machine. With the improvement in image quality in the recent years, the image quality of copies produced by copying machines has reached a level close to the image quality of prints.

PCT Japanese Translation Patent Publication No. 2001-506212 discloses an image forming system using a copying machine meeting on-demand printing needs. In this image forming system, in order to cope with a variety of materials, a plurality of printing paper decks that can store large numbers of sheets of printing paper are connected to one another.

In addition, Japanese Patent Laid-Open No. 2000-211803 discloses an image forming system that uses consecutive job operations to perform post-processing on imaged sheets output from a copying machine. Typical post processing includes an inserting process in which a sheet such as a cover sheet or a divider is inserted between sheets output from a copying machine performing Z-folding (e.g., a process that performs Z-folding of a A3 size sheet into a A4 size), a stapling process for binding a bundle of sheets, a punching process for punching sheets, and a binding process such as gluing and bookbinding.

FIG. 25 shows an example of the above image forming system. In this image forming system, a copying machine A is connected to a plurality of large-capacity printing paper decks B connected to one another, so that a large number of sheets of printing paper of various types can be fed to the copying machine A. In addition, the copying machine A is connected to a sheet ejecting unit C in which post-processing, such as a Z-folding process, an inserting process, a stapling process, a punching process, and a bookbinding process, is performed on imaged sheets of printing paper produced by the copying machine A.

In addition, Japanese Patent Laid-Open No. 5-53478 discloses an image forming apparatus having a copying machine and a paper feeding unit that can accommodate sheets of paper of plural types. This image forming apparatus includes a re-feeding unit which stacks sheets fed by the feeding unit and which feeds the stacked sheets to a printer.

In the image forming system shown in FIG. 25 in which the large-capacity printing paper decks B are connected, it is common for a carriage path from each printing paper deck B to the copying machine A is to be shared. This structure has the following problems.

For example, in the case of a job that makes a bundle of sheets of material paper of plural types, a change in paper type may require a change of the printing paper deck B in use. For example, when paper feeding from one printing paper deck B which is the closest to the copying machine A is changed to another printing paper deck B which is the farthest from the copying machine A, paper feeding from the printing paper deck B under normal feeding timing increases an interval (hereinafter referred to as a "sheet interval") between sheets of printing paper. This causes a problem in that productivity decreases.

Productivity cannot be maintained, with the sheet interval maintained to be constant, unless techniques for solving the above problems are performed. Techniques include changing the paper feeding timing or the like in view of the number of the printing paper decks B or the arrangement of the printing paper decks B for connection, carrying printing paper on the carriage path at an increased speed in order to reduce the sheet interval, or complex control of the carriage carries a sheet of printing paper to a predetermined position on the carriage path and allows the sheet to be on standby beforehand, and restarting the sheet carriage at the standby position.

In addition, the image forming apparatus disclosed in Japanese Patent Laid-Open No. 5-53478 includes a re-feeding unit which stacks sheets of printing paper from a plurality of paper feeding units and which supplies the sheets to a printer. However, during a period in which the sheets are carried from each paper feeding unit to the re-feeding unit, the printing paper is not fed to the printer, so that the productivity of the printer is low. Also, when sheets of printing paper of different types are stacked in the paper feeding units, for example, it is difficult to alternately feed the sheets of different types to the printer.

SUMMARY OF THE INVENTION

In view of the above circumstances, it is an object of the present invention to provide an image forming system in which printing-paper carrying control is simplified and which has increased productivity of image formation.

An image forming system of the present invention includes an image forming apparatus which forms an image on a sheet, a plurality of sheet storage units each of which store sheets to be fed to the image forming apparatus, and a temporary storage apparatus which includes a plurality of temporary storage trays for temporarily storing sheets supplied from the sheet storage units, and a feeding unit which feeds the image forming apparatus with the sheets stored in the temporary storage trays.

In another aspect of the present invention there is provided the above-described image forming system in combination with a direct path from the sheet storage units to the image forming apparatus, the direct path not using any of the temporary storage units.

In yet another aspect of the present invention, there is provided the above-described image forming system together with a horizontal carriage path, to the sheet storage units, wherein the sheet storage units are horizontally and collinearly disposed, the horizontal carriage path carries sheets fed from each of the horizontally and collinearly disposed sheet storage units, and the horizontal carriage path is connected to the direct path.

In still another aspect of the present invention, there is also included a control means for asynchronously performing an operation of supplying the sheets from the sheet storage units to the temporary storage trays, and for controlling an operation of feeding the sheets from the temporary storage units to the image forming apparatus.

In still yet another aspect of the present invention, there is also provided assignment control means for assigning one of the temporary storage trays for storing the sheets fed from the sheet storage units and control means for controlling sheet storage so that the sheets carried from each of the sheet storage units are temporarily stored in the assigned temporary storage tray.

In still yet another aspect of the present invention, there is also provided a sheet carrying path between the plurality of sheet storage units and a temporary storage apparatus and control means for controlling sheet conveyance so that when a sheet jam occurs on the sheet carrying path, sheet supplying from the sheet storage units to the temporary storage apparatus is stopped and sheet feeding from the temporary storage apparatus to the image forming apparatus is continued.

In still yet another aspect of the present invention, there is also provided indicating means for indicating that the sheet supplying operation to the temporary storage apparatus has been interrupted when the sheet jam occurs on the sheet carrying path between the sheet storage unit and the temporary storage apparatus.

Further objects, features and advantages of the present invention will become apparent from the following description of the preferred embodiments with reference to the accompanying drawings.

DESCRIPTION OF THE PREFERRED EMBODIMENTS

Specific embodiments of the present invention are described below with reference to the accompanying drawings.

Figure 1:
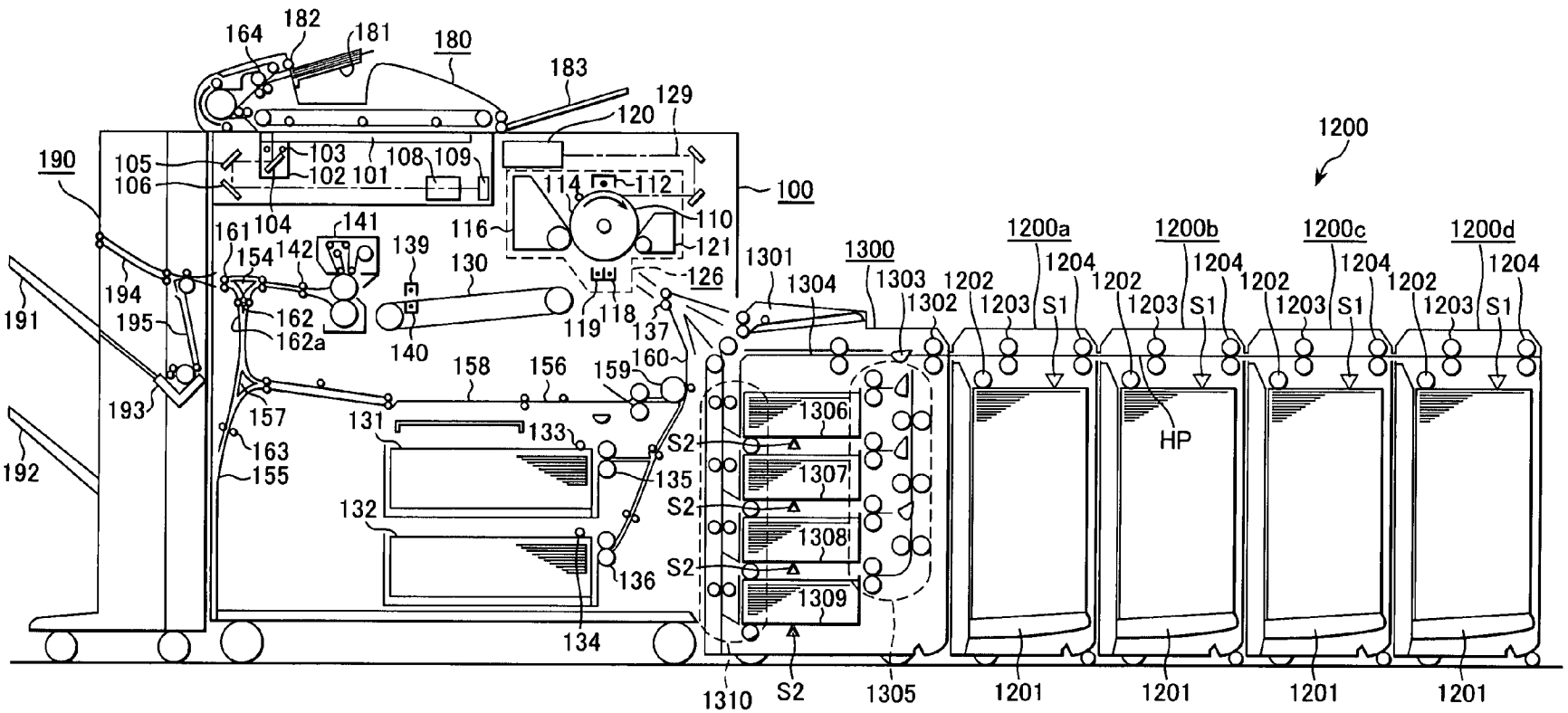
FIG. 1 is a cross-sectional view showing the structure of an image forming system according to an embodiment of the present invention.

FIG. 1 is a cross-sectional view showing the structure of an image forming system according to an embodiment of the present invention.

Image Forming Apparatus

FIG. 1 shows an image forming apparatus 100. The image forming apparatus 100 includes a glass platen 101 used as a plate on which a document is placed, and a scanner 102. The scanner 102 includes a document lighting lamp 103 and a scanning mirror 104. The image of the document placed on the glass platen 101 is scanned by the scanner 102, which is controlled so as to reciprocate in a predetermined direction (the horizontal direction shown in FIG. 1) by a motor (not shown). Light reflected by the document passes through a lens 108 after being reflected by scanning mirrors 104 to 106, and is focused in an image sensor unit (CCD sensor) 109, whereby the reflected light is converted into an electric signal.

An exposure control section 120 includes a laser output portion and a polygon scanner. The exposure control section 120 emits a laser beam 129 to a photosensitive drum 110 in an image forming unit 126. For the electric signal obtained by performing photoelectrically converting the reflected light (from the document) output from the image sensor unit 109, the laser beam 129 is modulated based on an image signal obtained by performing predetermined image processing (described later).

Around the photosensitive drum 110, a primary charger 112, a developing unit 121, a transfer charger 118, a separation charger 119, a cleaner 116, and a pre-exposure lamp 114 are provided and which together constitute the image forming unit 126. On the downstream side of the image forming unit 126, a carrying belt 130, before-fixation chargers 139 and 140, and a fixing unit 141 are disposed.

The image forming apparatus 100 has, in its lower portion, an upper paper feed cassette 131 and a lower paper feed cassette 132. The upper and lower paper feed cassettes 131 and 132 respectively have pickup rollers 133 and 134, and paper feed rollers 135 and 136 in order to feed sheets of printing paper contained therein. A sheet of printing paper carried by the paper feed roller 135 or 136 is sent to a resist roller 137 after passing through a path 160.

The photosensitive drum 110 is controlled by a motor (not shown) to rotate in the direction indicated by the arrow shown in FIG. 1. The primary charger 112 charges the photosensitive drum 110 to have desired potential. The exposure control section 120 emits the laser beam 129 onto the photosensitive drum 110, so that an electrostatic latent image is formed on the photosensitive drum 110. The latent image formed on the photosensitive drum 110 is developed by the developing unit 121, whereby it is visualized as a toner image.

The sheet fed from the upper paper feed cassette 131 or the lower paper feed cassette 132 by the pickup roller 133 or 134, respectively, or a sheet of printing paper fed from a sheet deck assembly 1200 (described later), is sent to the image forming unit 126 by the resist roller 137. The sheet of printing paper is sent to the photosensitive drum 110 at a timing established by the resist roller 137, and the toner image on the photosensitive drum 110 is transferred onto the sheet by the transfer charger 118. After the transfer of the toner image, the cleaner 116 removes remaining toner on the photosensitive drum 110, and the pre-exposure lamp 114 erases residual charge.

The image-transferred sheet is separated from the photosensitive drum 110 by the separation charger 119, and is carried in the left direction shown in FIG. 1 by the carrying belt 130. The toner image on the sheet is re-charged by the before-fixation chargers 139 and 140, and is pressed and heated by the fixing unit 141, whereby the toner image is fixed to the sheet. The image-fixed sheet is carried to a paper ejecting unit 190 (described later).

A paper ejecting flapper 154 is disposed between an ejecting roller 142 and the paper ejecting unit 190 and is used to switch between an ejecting paper path and a double-sided-recording/multiplex-recording paper path. The sheet sent from the ejecting roller 142 is carried to the double-sided-recording/multirecording paper path when the paper ejecting flapper 154 is lifted. In the case of double-sided recording, a sheet of printing paper which has one fixation-completed surface is sent from the ejecting roller 142 and is inverted by an inversion path 155. The inverted sheet is carried through a lower carriage path 158 and is led to a re-feeding tray 156 again. A multiflapper 157 switches between the double-sided-recording paper path and the multirecording paper path. By bringing down the multiflapper 157, the sheet is directly led to the lower carriage path 158 without passing through the inversion path 155, thus enabling multirecording. A paper feeding roller 159 is used to re-feed the sheet to the image forming unit 126.

An ejecting roller 161 is disposed in the vicinity of the paper ejecting flapper 154. The ejecting roller 161 operates to eject the sheet sent from the ejecting roller 142, with the paper ejecting flapper 154 switched to the ejecting side (with the paper ejecting flapper 154 not lifted). As described above, in the double-sided-recording (double-sided copying) or the multirecording (multi-copying), the paper ejecting flapper 154 is raised, and the image-fixed sheet is allowed to pass through the lower carriage path 158 before being stored in the re-feeding tray 156.

The sheets of printing paper accommodated on the re-feeding tray 156 are separated one by one by from the bottom by the paper feeding roller 159. One separated sheet is led to the resist roller 137 in the image forming apparatus 100 after passing through the path 160 again. The re-feeding tray 156 may have either a form (intermediate tray method) in which plural sheets of printing paper are stacked and on standby and each sheet is fed, or a form (through-pass method) in which a single sheet of printing paper is fed from an on-standby state.

When a sheet of printing paper is ejected from the image forming apparatus 100, with the sheet inverted, the paper ejecting flapper 154 is lifted, the multiflapper 157 is brought down in the right direction, and the sheet to be ejected is allowed to pass through the inversion path 155 again. The sheet is carried to a second feeding roller 162*a* by an inversion roller 163 at the time that the rear end of the sheet passes through a first feeding roller 163, and is ejected to the exterior by the ejecting roller 161.

Auto Document Feeder

An auto document feeder (ADF) 180 is provided on the top side of the image forming apparatus 100. The ADF 180 separates, from the bundle of documents placed on a document tray 181, only the top document, and carries the separated document onto the glass platen 101 by a document feeding roller 164. After that, the document is scanned by the scanner 102, and the scanned document is ejected to a document ejecting tray 183, or is returned to the document tray 181 again.

Paper Ejecting Unit

The paper ejecting unit 190 is used to put together and bind sheets of printing paper ejected from the image forming apparatus 100. When processing operations after paper ejecting and binding, such as sorting and stapling, are not set, a sheet of printing paper passes through a carriage path 194 and is ejected to an ejecting tray 191 without passing through a processing tray 193. Conversely, when the processing operations after paper ejection and binding are set, each sheet through a carriage path 195 is stacked for collection. After ejection of the imaged sheets of printing paper constituting the first bundle ends, the bundle of sheets is stapled, and is ejected as a bundle to the ejecting tray 191 or 192. In the case of setting the processing operations after paper ejection and binding, the bundle is basically ejected to the ejecting tray 192. However, the tray for ejection is switched to the ejecting tray 191 depending on a condition such as a state in which the ejecting tray 192 is fully loaded. The ejecting trays 191 and 192 are controlled by a motor (not shown) to move vertically. Before the image forming operation starts, each tray 191 or 192 for use in ejection is moved to the position of the processing tray 193.

A feeding buffer apparatus 1300 and a large-capacity sheet deck assembly 1200 (printing paper decks 1200*a* to 1200*d*), which are fully described below, are connected in series to the image forming apparatus 100.

Printing Paper Decks

The sheet deck assembly 1200 consists of printing paper decks 1200*a* to 1200*d* used as sheet storage units. Each of the printing paper decks 1200*a* to 1200*d* has a lifter 1201 in which sheets of printing paper are stacked and which can move up and down, and a paper feeding roller 1202 for feeding the sheets. The lifter 1201 is controlled to move up in accordance with the number of sheets of printing paper so that the printing paper always abuts against the paper feeding roller 1202 at a predetermined pressure. The lifter 1201 includes a remaining-amount detecting sensor S1 for detecting the remaining amount of the printing paper. The printing paper decks 1200*a* to 1200*d* can store various types of materials such as sheets of plain paper having different thicknesses, coated paper, and colored paper.

Each of the printing paper decks 1200*a* to 1200*d* has a printing paper carrying path horizontally disposed, which forms a horizontal carriage path HP. A sheet of printing paper sent from the upstream side (the upper right side in FIG. 1) is carried to the downstream side by carrying rollers 1203 and 1204. Accordingly, the sheet from an upper stream printing paper deck is sequentially carried on a paper feeding path in each lower stream printing paper deck, and is finally fed to the image forming apparatus 100. The paper feeding path can perform a carrying operation in order for the sheet deck assembly 1200 to feed the printing paper, even if the deck is opened from the deck front side (the side perpendicular to the plane of FIG. 1). In addition, an operation unit (not shown) of the deck can set information such as the size of paper for storage and a paper type.

Feeding Buffer Apparatus

Next, the feeding buffer apparatus 1300 (temporary sheet storage apparatus), which is characteristic in the present invention, is described below.

A sheet of printing paper fed through the horizontal carriage path HP from each of the printing paper decks 1200*a* to 1200*d* is fed to the image forming apparatus 100 through the feeding buffer apparatus 1300. In the feeding buffer apparatus 1300, a straight path 1304 used as a carriage path for directly sending each sheet carried from the sheet deck assembly 1200, and a plurality of feeding buffer trays (temporary storage trays) 1306 to 1309 for temporarily storing the sheet carried from the sheet deck assembly 1200 are vertically disposed.

The straight path 1304 has carrying rollers 1302 which are provided thereon and which receive and carry the sheet fed from each of the printing paper decks 1200*a* to 1200*d*, and a flapper 1303 which is provided on the downstream side and which is used to switch the direction of the sheet sent by the carrying rollers 1302 between the direction of carriage through the straight path 1304 and the direction of the feeding buffer trays 1306 to 1309.

In the case of supplying the feeding buffer apparatus 1300 with the sheet, a flapper 1303 is raised to switch the carrying direction of the sheet to the downward direction in FIG. 1, and the sheet is temporarily stored in one of the feeding buffer trays 1306 to 1309 through a paper feeding switching mechanism 1305. Each of the feeding buffer trays 1306 to 1309 has a remaining-amount detecting sensor S2 and an operation unit (not shown), whose details are described later. Also, each of the feeding buffer trays 1306 to 1309 has an adjustment mechanism (not shown). This mechanism ensures that the sheet is stored in one of the feeding buffer trays 1306 to 1309.

The paper feeding switching mechanism 1305 has a vertical path branching off from the straight path 1304, flappers for selectively supplying the sheet from the vertical path to the feeding buffer trays 1306 to 1309, and pairs of carrying rollers for sheet carriage to the feeding buffer trays 1306 to 1309. When the paper feeding switching mechanism 1305 has, for example, the state shown in FIG. 1, the sheet is supplied to the feeding buffer tray 1308.

When paper feeding is performed from each of the feeding buffer trays 1306 to 1309 to the image forming apparatus 100, a feeding control mechanism 1310 in the feeding buffer apparatus 1300 separates one at the bottom of the sheets of printing paper stored in the designated feeding buffer tray, and feeds the sheet. This feeds sheets of the printing paper from the designated feeding buffer tray in the order that the sheets of printing paper are stored.

In each of the feeding buffer trays 1306 to 1309, a sheet storing direction is identical to a sheet ejecting direction, and the bottom one of sheets of printing paper is separated and fed by the feeding control mechanism 1310. Thus, the sheet storing operation and the sheet ejecting operation can be simultaneously performed.

In a multi-feeding unit 1301 provided on the top surface of the feeding buffer apparatus 1300, special size sheets of printing paper or sheets of printing paper made of special material which cannot be fed from the paper feed cassettes 131 and 132 or from the sheet deck assembly 1200 are set by a user. This enables the special size sheets or the special material sheets to be directly fed to the image forming apparatus 100.

Controllers

Figure 2:
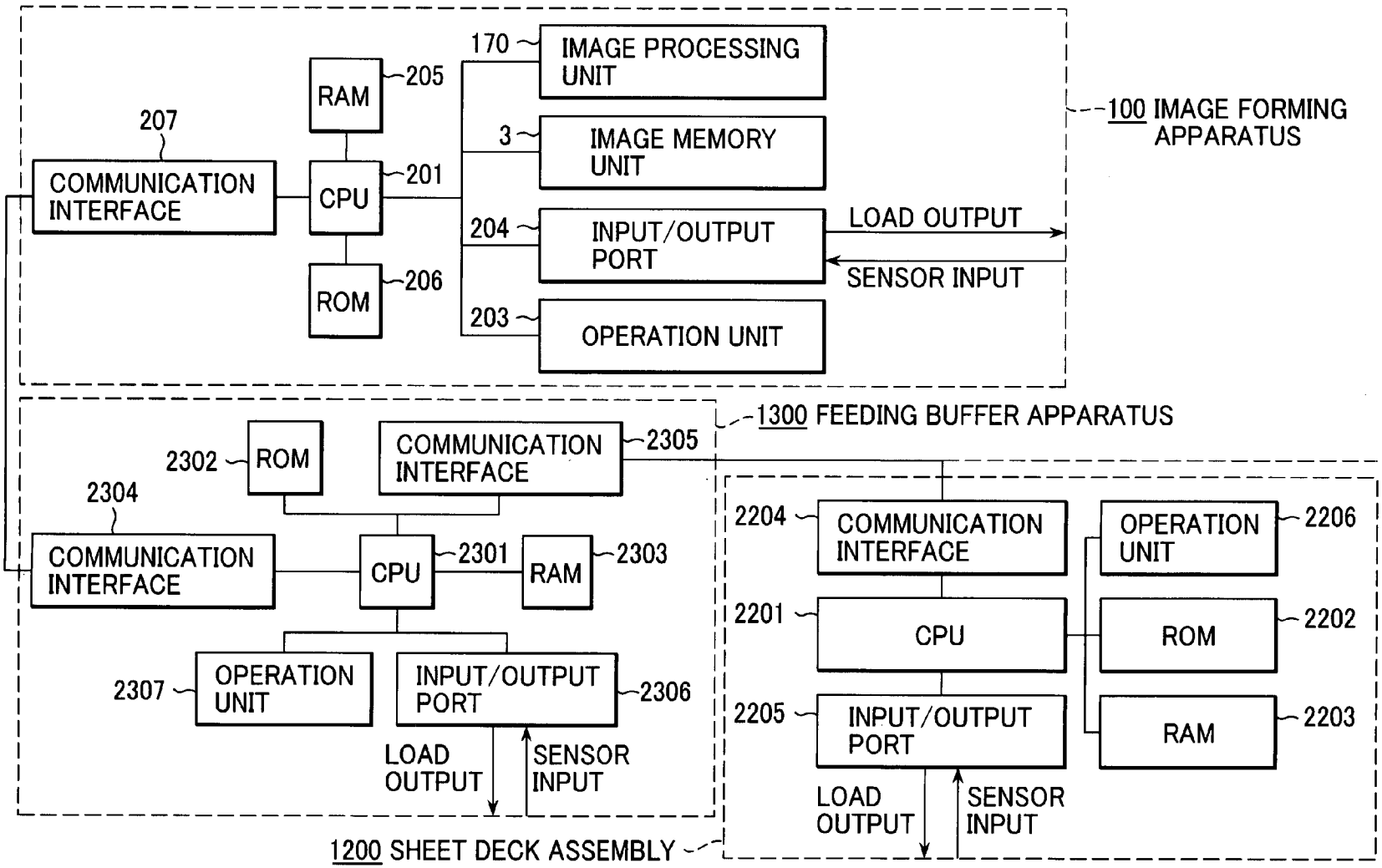
FIG. 2 is a block diagram showing the image forming system shown in FIG. 1.

FIG. 2 is a block diagram showing the configurations of controllers respectively provided in the image forming apparatus 100, the sheet deck assembly 1200, and the feeding buffer apparatus 1300.

A central processing unit (CPU) 201 performs basic control of the image forming apparatus 100. A read-only memory (ROM) 206 storing a control program, a work random access memory (work RAM) 205 for use in performing processing, and an input/output port 204 are connected to the CPU 201 by an address bus and a data bus. Some areas of the RAM 205 are used as a backup RAM in which data is not erased, even if the power is off. The input/output port 204 connects to various load devices controlled by the image forming apparatus 100, such as a motor and a clutch, and input devices for the image forming apparatus 100, such as sensors for detecting the position of a sheet of printing paper.

The CPU 201 executes image-forming processing by performing sequential input/output control in accordance with the content of the control program in the ROM 206.

The CPU 201 connects to an operation unit 203, and controls display and key-input sections of the operation unit 203. The user uses the key-input section to instruct the CPU 201 to have an image forming operation mode and to switch display. Under the control of the CPU 201, the operation unit 203 uses its display section to display the operation status of the image forming apparatus 100 and an operation mode set by key inputting (details are described later). The CPU 201 connects to an image processing unit 170 for processing an electric signal obtained through conversion by the image sensor unit 109, and an image memory unit 3 for storing processed images.

A communication interface 207 is used to establish communication between the CPU 201 and the feeding buffer apparatus 1300. The communication interface 207 communicates with a CPU 2301 in the feeding buffer apparatus 1300 through a communication interface 2304 in the feeding buffer apparatus 1300.

The CPU 2301 performs basic control of the feeding buffer apparatus 1300, and connects to a ROM 2302 storing a control program, a work RAM 2303 for use in performing processing, and an input/output port 2306 through an address bus and a data bus. Some areas of the RAM 2303 are used as a backup RAM in which data is not erased, even if the power is off. The input/output port 2306 connects to various load devices controlled by the feeding buffer apparatus 1300, such as a motor and a clutch, and input devices for the feeding buffer apparatus 1300, such as sensors for detecting the position of a sheet of printing paper.

In addition, the CPU 2301 connects to an operation unit 2307, and controls display and key-input sections of the operation unit 2307. The user uses the key-input section to instruct the feeding buffer apparatus 1300 to perform an operation and to switch displays. The CPU 2301 controls the display section of the operation unit 2307 to display the operation status of the feeding buffer apparatus 1300 and an operation mode set by key inputting (details are described later).

A communication interface 2305 is used to establish communication between the CPU 2301 and the sheet deck assembly 1200. The communication interface 2305 communicates with the CPU 2201 in the sheet deck assembly 1200 through a communication interface 2204 in the sheet deck assembly 1200.

The CPU 2301 executes printing paper buffering by performing sequential input/output control through the input/output port 2306 in accordance with the control program in the ROM 2302. By issuing a command to the sheet deck assembly 1200, the CPU 2301 supplies printing paper from the sheet deck assembly 1200 to the feeding buffer apparatus 1300. In response to a command from the image forming apparatus 100, the CPU 2301 supplies printing paper from feeding buffer apparatus 1300 to the image forming apparatus 100.

The CPU 2201 performs basic control of the sheet deck assembly 1200. The CPU 2201 connects to a ROM 2202 storing a control program, a work RAM 2203 for use in performing processing, and an input/output port 2205 through an address bus and a data bus. Some areas of the RAM 205 are used as a backup RAM in which data is not erased, even if the power is off. The input/output port 2205 connects to various load devices controlled by the sheet deck assembly 1200, such as a motor and a clutch, and input devices for the sheet deck assembly 1200, such as sensors for detecting the position of a sheet of printing paper.

The CPU 2201 also connects to an operation unit 2206, and controls display and key-input sections of the operation unit 2206. The user uses the key-input section to instruct the CPU 2301 to control the sheet deck assembly 1200 to perform an operation, and to set a paper type, a paper size, etc. The CPU 2201 controls the display section of the operation unit 2206 to display the operation status of the sheet deck assembly 1200 and the paper type and size set by key input.

The CPU 2201 executes separation of sheets of printing paper and sheet carriage by performing sequential input/output control through the input/output port 2205 in accordance with the control program in the ROM 2202.

The CPU of each block can transmit information of the block through each of the communication interfaces 2204, 2304, and 207.

Image Processing Unit

Figure 3:
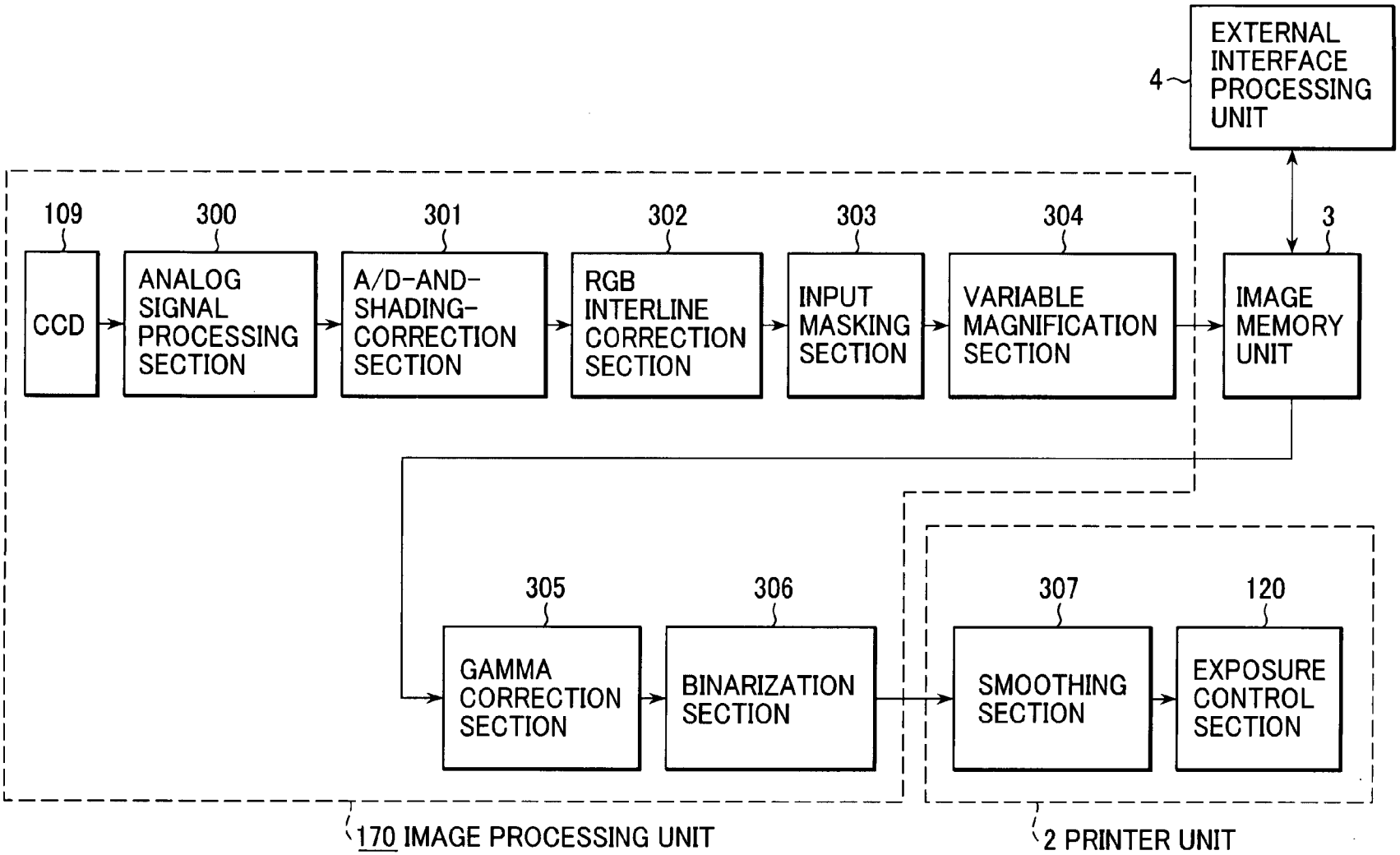
FIG. 3 is a block diagram showing an image processing unit in the image forming system shown in FIG. 1.

Next, the image processing unit 170 and the image memory unit 3 are respectively described below with reference to FIGS. 3 and 4. FIG. 3 is a block diagram showing the internal configuration of the image processing unit 170 and an apparatus connected to the image memory unit 3.

The flow of processing for printing a scanned image is now described in the following. The image of the document which is focused in the image sensor unit 109 after passing through the lens 108 is converted into an analog electric signal by the CCD sensor 109. The analog electric signal (converted image information) is input to an analog signal processing section 300. The analog signal processing section 300 performs processing, such as sampling-and-holding, and dark level correction, on the input analog signal. The processed signal is converted from analog to digital form, and shading correction is performed on the digital signal by the A/D-and-shading-correction section 301. In the shading correction, correction on a variation in each pixel of the CCD sensor 109, and correction on a variation in light intensity caused by light distribution characteristics of the document lighting lamp 103 are performed.

After that, an RGB interline correction section 302 performs RGB interline correction. Rays of light which are received by R, G, and B light receiving sections of the CCD sensor 109 have deflections depending on positional relationships among the R, G, and B light receiving sections. Accordingly, synchronization among R, G, and B signals is established.

After that, an input masking section 303 performs input masking to convert brightness data to density data. When R, G, and B levels are output from the CCD sensor 109, the levels are influenced by color filters provided on the CCD sensor 109. Accordingly, by correcting the influence, the levels are converted to pure R, G, and B levels.

Next, a variable magnification section 304 performs magnifying processing on the image data at a desired magnification. The processed image data is sent and stored in the image memory unit 3. The image memory unit 3 also receives image data input from a computer through an external interface processing unit 4.

For printing the stored image data, image data is initially sent from the image memory unit 3 to a gamma correction section 305. In order to produce an output in accordance with a density set by the operation unit 203, the gamma correction section 305 converts the original density data to density data corresponding to the desired output density, based on a lookup table considering printer characteristics.

Next, the density data is sent to a binarization section 306. The binarization section 306 binarizes multivalue density data. In the case of multivalue density data, for example, 8-bit density data, the density level is one value between "0" to "255". By binarizing the 8-bit density data, the number of density levels can be reduced to only two, "0" and "255". In other words, to represent the density of a pixel, 8-bit data is required. However, by performing binarization, only 1-bit data is only required. This reduces the memory capacity for storing the image data. However, image gradation changes from the original 256 levels to two levels, so that, in general, the image quality of an image having many intermediate tones, such as a photographic image, remarkably decreases when the image is binarized.

Accordingly, pseudo representation of intermediate tones by using binarized data is important. Here, the error diffusion method is used as a technique for pseudo representation of intermediate tones by using binarized data. In this method, binarization is performed by performing processing in which, when the density of an image is greater than a threshold value, the density data "255" is set, and, when the density of the image is equal to or less than the threshold value, the density data "0" is set. Then, the difference between the actual density data and the binarized data is calculated as an error signal, and the error signal is distributed to adjacent pixels. The distribution of the error is performed by multiplying an error generated in binarization by a predetermined weighting coefficient on a matrix, and adding the product to each adjacent pixel. This stores the density average of the entire image and enables pseudo representation of intermediate tones by using two levels.

The binarized density data is sent to a smoothing section 307 in the printer unit 2. The smoothing section 307 complements the data so that ends of lines of the binarized image can be smoothed, and outputs the complement image data to the exposure control section 120. As described above, the exposure control section 120 forms the electrostatic latent image of the image data on the photosensitive drum 110.

Next, the flow of processing in the case of transferring the scanned image through a network is described below.

This flow is similar to that for printing the scanned image, up to storage of density data in the image memory unit 3. After that, the image data is sent from the image memory unit 3 to the external interface processing unit 4, and is transferred to a desired computer from the external interface processing unit 4 through a network.

Image Memory Unit

Figure 4:
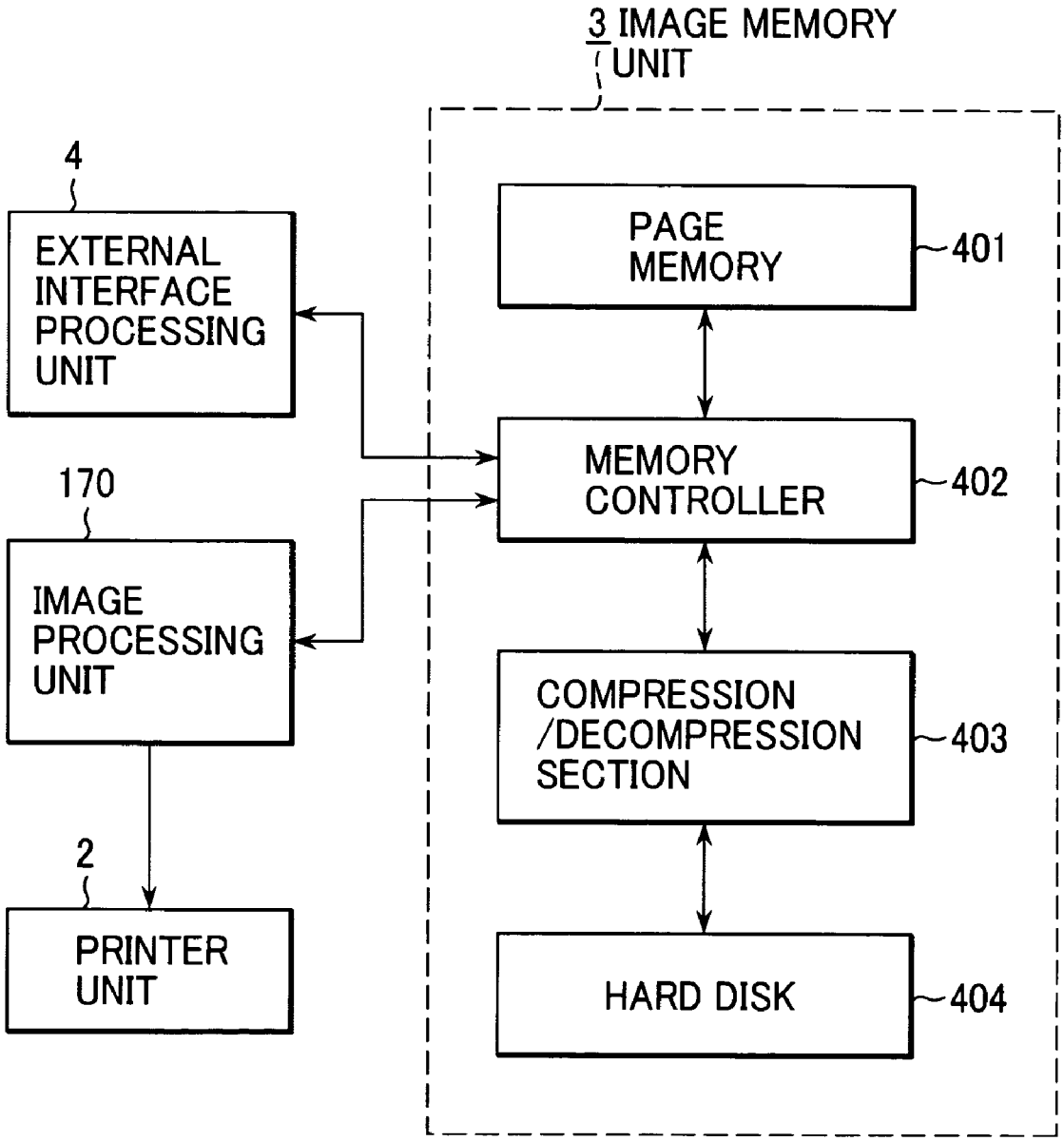
FIG. 4 is a block diagram showing an image memory unit in the image forming system shown in FIG. 1.

FIG. 4 is a block diagram showing the internal configuration of the image memory unit 3 and a peripheral apparatus. The image memory unit 3 includes a page memory 401, a memory controller 402, a compression/decompression section 403, and a hard disk 404.

Image data sent from the external interface processing unit 4 or the image processing unit 170 to the image memory unit 3 is written in the page memory 401 by the memory controller 402. After that, the image data is sent to the printer unit 2 through the image processing unit 170, or is stored on the hard disk 404. In the case of storing the image data on the hard disk 404, the image data is compressed by the compression/decompression section 403. The compressed data is written on the hard disk 404. The memory controller 402 also controls the page memory 401 to read image data stored on the hard disk 404. At that time, the compressed data read from the hard disk 404 is decompressed by the compression/decompression section 403, and the restored image data is written in the page memory 401. In addition, the memory controller 402 generates a DRAM refresh signal.

Accessing of the page memory 401 by the external interface processing unit 4, the image processing unit 170, and the hard disk 404 is mediated. In addition, in response to an instruction of the CPU 201, the image memory unit 3 controls determination of a write address to the page memory 401, a read address from the page memory 401, a reading direction, etc. These enable the CPU 201 to control a function of using the image processing unit 170 to perform output after completing a layout of document images in the page memory 401, a function of separating only a part of an image and outputting the part, and a function of rotating an image.

Also, for example, regarding a sorting mode, for a bundle of documents, control that prints images of the documents read in order recorded in the image memory unit 3 is repeatedly performed. By performing the above control, a finisher having a smaller number of bins, such as the paper ejecting unit 190 in this embodiment, can serve as a sorter having many bins.

External Interface Processing Unit

Figure 5:
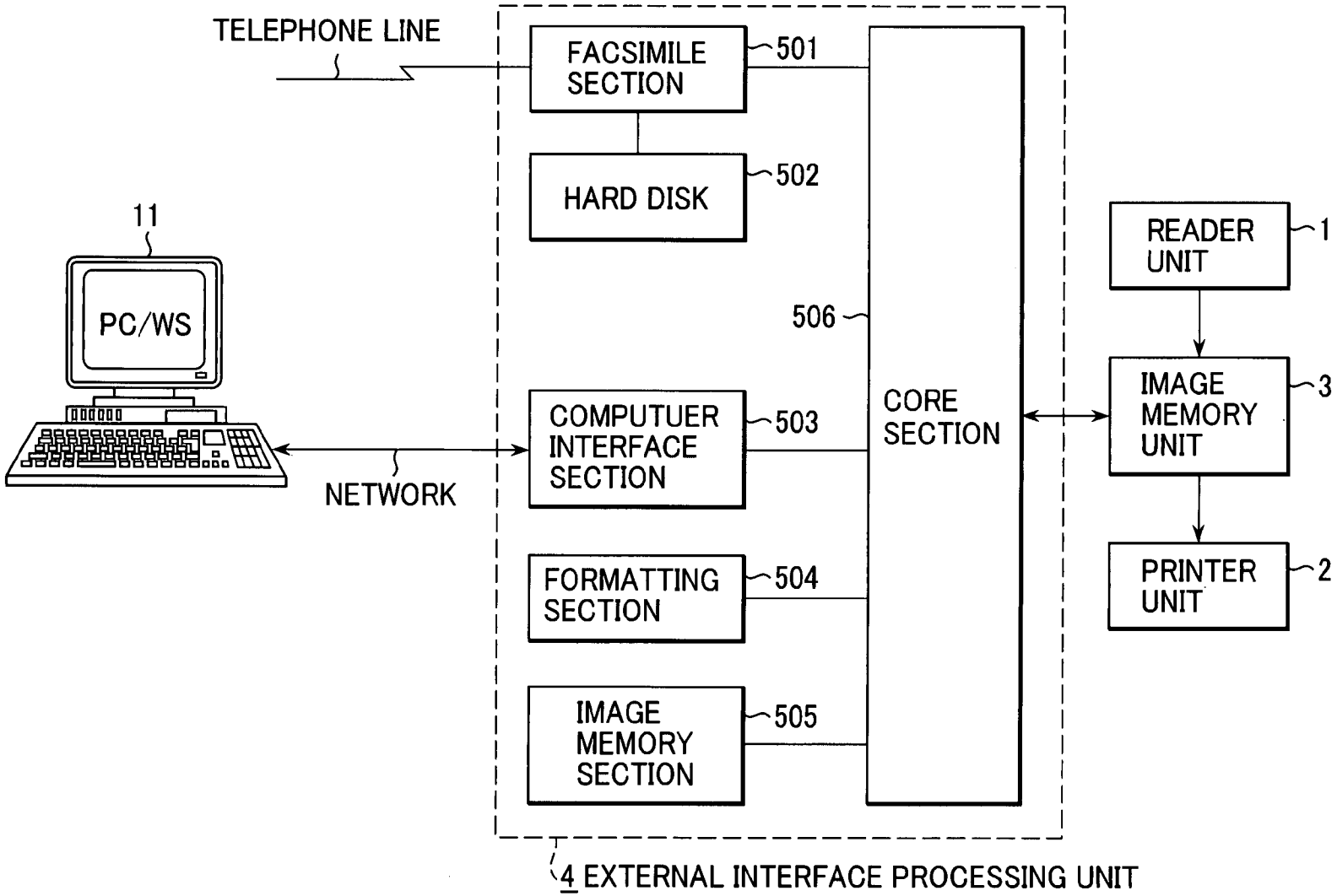
FIG. 5 is a block diagram showing an external interface processing unit in the image forming system shown in FIG. 1.

FIG. 5 is a block diagram showing the internal configuration of the external interface processing unit 4 and a peripheral apparatus.

The external interface processing unit 4 uses the image memory unit 3 to acquire the image data from the reader unit 1, and sends image data to an external computer and an external facsimile machine through a network or a telephone line. The external interface processing unit 4 uses the image memory unit 3 (and the image processing unit 170) to output, to the printer unit 2 for image formation, image data sent from the external computer or the facsimile machine through the network or telephone line.

The external interface processing unit 4 includes a facsimile section 501, a hard disk 502 for storing communication image data in the facsimile section 501, a computer interface section 503 for establishing connection to the external computer 11, a formatting section 504, and an image memory section 505.

The facsimile section 501 connects to a public circuit through a modem (not shown). The facsimile section 501 receives facsimile communication data from the public circuit, and transmits facsimile communication data to the public circuit. By using images for facsimile stored in the hard disk 502, the facsimile section 501 realizes facsimile functions such as facsimile transmission at a designated time, and transmission of image data in response to an inquiry using a designated password from another communication party.

Accordingly, once an image is sent from the reader unit 1 to the facsimile section 501 through the image memory unit 3 and is stored in the hard disk 502 for facsimile use, facsimile transmission can be performed without using the reader unit 1 and the image memory unit 3 for the facsimile functions.

The computer interface section 503 is used to establish data communication with the external computer 11, and has a local area network (LAN), a serial interface, a small computer system interface (SCSI) interface, and a Centronics interface for inputting data for a printer. The statuses of the printer unit 2 and the image memory unit 3 are indicated to the external computer 11 through the computer interface section 503. Alternatively, transfer of an image read by the reader unit 1 to the external computer 11 is performed in response to an instruction of the external computer 11.

The computer interface section 503 also receives printing image data from the external computer 11. In this case, since the printing image data from the external computer 11 is described in dedicated printer codes, the formatting section 504 converts the received data codes into raster image data, by which image formation can be performed by the printer unit 2. The raster image data obtained by the conversion is loaded into the image memory section 505. In addition, in the case of transmitting image data to the external computer 11 through the computer interface section 503, the formatting section 504 performs, on the printing image data transmitted from the image memory unit 3, density conversion and conversion into an image format recognizable by the external computer 11.

The image memory section 505 is used as a memory into which the raster image in the formatting section 504 is loaded, or is also used when the image from the reader unit 1 is sent to the external computer 11 (network scanner function). In other words, in the case of sending the image (from the reader unit 1) to the external computer 11 through the computer interface section 503, the image data sent from the image memory unit 3 is temporarily loaded into the image memory section 505 and is converted into the format of data to be sent to the external computer 11. The converted image data is sent from the computer interface section 503 to the external computer 11.

The core section 506 controls and manages data transfers among the facsimile section 501, the computer interface section 503, the formatting section 504, the image memory section 505, and the image memory unit 3. This performs appropriate data outputting because exclusive control and priority control are performed under the control of the core section 506, even if the external interface processing unit 4 connects to a plurality of image output units, or there is only one image transfer path to the image memory unit 3.

Operation Unit

Figure 6:
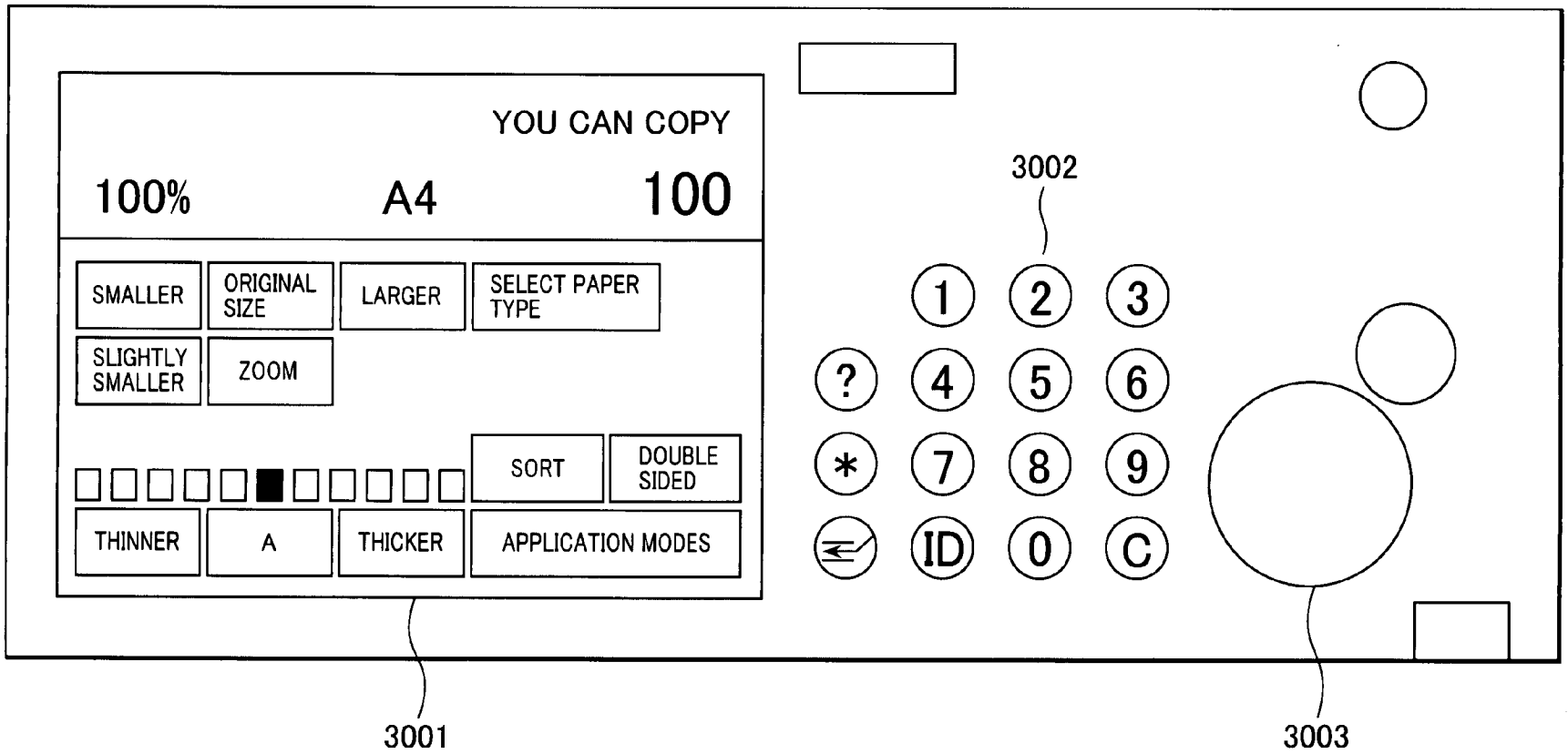
FIG. 6 is a schematic illustration of the configuration of an operation unit for an image forming apparatus in the image forming system shown in FIG. 1.

FIG. 6 is a schematic illustration of the configuration of the operation unit 203 for the image forming apparatus 100. In FIG. 6, a display section 3001 displays the operation status of the image forming apparatus 100, various messages such as operation instructions to the user, an operating procedure, etc.

The surface of the display section 3001 is formed by a touch panel, and functions as selection keys when corresponding portions of the surface are touched. A numeric key pad 3002 is used to enter numerals. A start key 3003 is pressed to start a copying operation.

Figure 7:
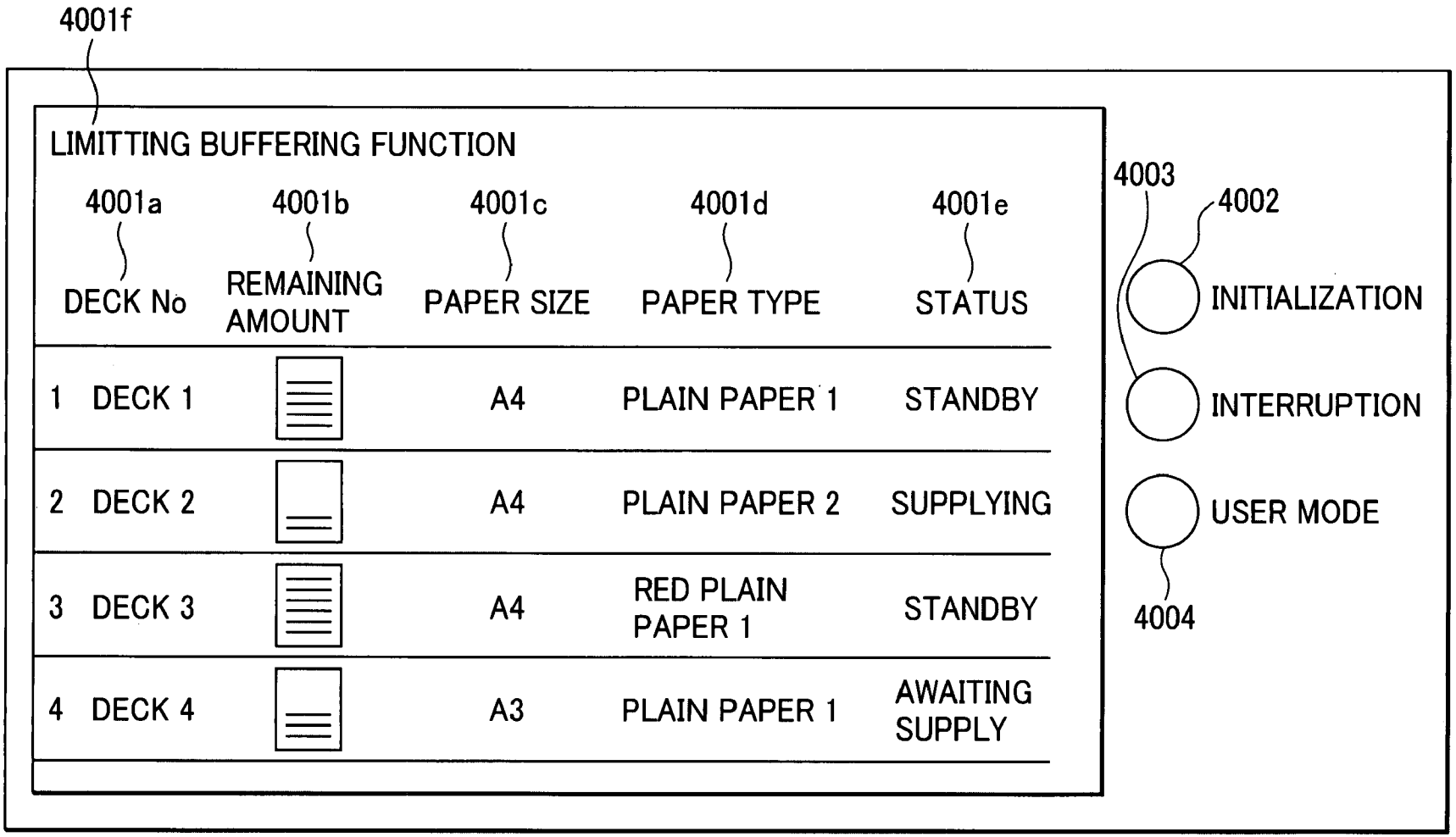
FIG. 7 is a schematic illustration of the configuration of an operation unit for a feeding buffer apparatus in the image forming system shown in FIG. 1.

FIG. 7 is a schematic illustration of the configuration of an operation unit 2307 for the feeding buffer apparatus 1300.

In FIG. 7, a display section 4001 includes a deck display portion 4001*a* for displaying printing paper deck numbers corresponding to the feeding buffer trays in the feeding buffer apparatus 1300, a remaining-sheet-amount display portion 4001*b*, a printing-paper-size display portion 4001*c*, a paper-type display portion 4001*d*, a status display portion 4001*e*, and a message display portion 4001*f*.

The deck indicating portion 4001*a* displays deck numbers (deck ID information) corresponding to printing paper decks.

Information in the remaining-sheet-amount display portion 4001*b* is divided based on detection signals from the remaining-amount detecting sensors S1 in the printing paper decks 1200*a* to 1200*d* and the remaining-amount detecting sensors S2 in the feeding buffer trays 1306 to 1309. The remaining-sheet-amount display portion 4001*b* displays the following six levels:

(Remaining-Paper-Amount Levels)

Level 0: State in which the feeding buffer tray has no printing paper and the printing paper deck has no printing paper;

Level 1: State in which the feeding buffer tray has printing paper and the printing paper deck has no printing paper;

Level 2: State in which 1% to 25% of the maximum amount of printing paper remains in the printing paper deck;

Level 3: State in which 26% to 50% of the maximum amount of printing paper remains in the printing paper deck;

Level 4: State in which 51% to 75% of the maximum amount of printing paper remains in the printing paper deck; and Level 5: State in which 76% to 100% of the maximum amount of printing paper remains in the printing paper deck.

The printing-paper-size display portion 4001*c* display paper sizes, and the paper-type display portion 4001*d* displays paper-type information (such as cardboard, plain paper, and colored paper).

The status display portion 4001*e* displays the status of each of the feeding buffer trays 1306 to 1309. The displayed statuses are as follows (In the following, a feeding buffering operation represents an operation of feeding printing paper from each of the printing paper decks 1200*a* to 1200*d* to each of the feeding buffer trays 1306 to 1309):

(Buffer Tray Status)

Supplying: Status in which the feeding buffer is operating;

Awaiting: Status of awaiting a feeding buffering operation (waiting for a previously performed feeding buffering operation to end);

No Paper: Status in which printing paper in the feeding buffer tray runs out;

Supplying Deck: Status in which printing paper is being supplied to the printing paper deck during the operation of a job;

Unused: Status in which a printing paper deck to be supplied with printing paper is not detected; and Standby: Other than the above statuses.

The message display portion 4001*f* displays a message which is information to the user.

An interruption key 4003 is used to perform an operation of supplying printing paper to the printing paper deck during the operation of a job. By pressing the interruption key 4003, the feeding buffering operation is prohibited, enabling the printing paper deck to be supplied with printing paper. By pressing the interruption key 4003 again after finishing paper supply, a state in which the feeding buffering operation is allowed is activated.

Feeding Buffer Assignment Control

Next, feeding buffer assignment control in the image forming system is described below.

The feeding buffer assignment control determines in which of the feeding buffer trays 1306 to 1309 in the feeding buffer apparatus 1300, the printing paper in the sheet deck assembly 1200 is to be stored.

In the image forming system shown in FIG. 1, the feeding buffer apparatus 1300 and the sheet deck assembly 1200 have pieces of management information for controlling feeding buffer assignment. The management information is as follows:

(Printing-Paper-Deck Managing Data)

Deck-ID information: ID information for identification from other printing paper decks;

Deck-stored-paper-size information: information of the size of printing paper stored in printing paper deck;

Deck-stored-paper-type information: information of the type of printing paper stored in printing paper deck;

(Feeding-Buffer-Apparatus Managing Data)

Buffer-deck ID: ID information of a printing paper deck having printing paper to be stored in feeding buffer tray;

Buffer-stored-paper-size information: information of the size of printing paper stored in feeding buffer tray; and Buffer-stored-paper-type information: information of the type of printing paper stored in feeding buffer tray.

Each printing paper deck has management data items, and each buffer tray has management items. Regarding the paper size, paper type, deck ID, etc., dedicated codes common to the image forming system are set.

In addition, the printing-paper-deck managing data and the feeding-buffer-apparatus managing data have the following pair relations:

a pair of deck-ID information and buffer-deck ID;

a pair of deck-stored-paper-size information and buffer-stored-paper-size information; and a pair of deck-stored-paper-type information and Buffer-stored-paper-type information.

In the case of assigning a printing paper deck to a predetermined feeding buffer tray, deck-ID information is updated to change to buffer-deck ID, deck-stored-paper-size information is updated to change to buffer-stored-paper-size information, and deck-stored-paper-type information is updated to change to buffer-stored-paper-type information.

Accordingly, when the feeding-buffer-apparatus managing data of one of the feeding buffer trays 1306 to 1309 completely coincides with the printing-paper-deck managing data of one printing paper deck, the feeding buffer tray is assigned to the printing paper deck.

The above types of management data are stored in a backup RAM in each apparatus so as not be erased, even if the power is switched off.

Next, in the image forming system in FIG. 1, when the printing paper decks 1200*a* to 1200*d* are represented by printing paper decks 1 to 4, and the feeding buffer trays 1306 to 1309 are represented by feeding buffers 1 to 4, specific data configurations are described below. In the data configurations, printing paper decks 1 to 4 and the feeding buffers 1 to 4 are assigned in numerical order.

The data configurations are as follows:

(printing-paper-deck managing data)

Printing paper deck 1: deck-ID information: 0×01;
Deck-stored-paper-size information: A4 (0×03);
Deck-stored-paper-size information: plain paper 1 (0×01);
Printing paper deck 2: deck-ID information: 0×02;
Deck-stored-paper-size information: A4 (0×03);
Deck-stored-paper-size information: plain paper 2 (0×02);
Printing paper deck 3: deck-ID information: 0×03;
Deck-stored-paper-size information: A4 (0×03);
Deck-stored-paper-type information: red plain paper 1 (0×11);
Printing paper deck 4: deck-ID information: 0×04;
Deck-stored-paper-size information: A3 (0×07);
Deck-stored-paper-type information: plain paper 1 (0×01);

(Feeding-Buffer-Apparatus Managing Data)

Feeding buffer 1: buffer-deck-ID information: 0×01;
Buffer-stored-paper-size information: A4 (0×03);
Buffer-stored-paper-type information: plain paper 1 (0×01);
Feeding buffer 2: buffer-deck-ID information: 0×02;
Buffer-stored-paper-size information: A4 (0×03);
Buffer-stored-paper-type information: plain paper 2 (0×02);
Feeding buffer 3: buffer-deck-ID information: 0×03;
Buffer-stored-paper-size information: A4 (0×03);
Buffer-stored-paper-type information: red plain paper 1 (0×11);
Feeding buffer 4: buffer-deck-ID information: 0×04;
Buffer-stored-paper-size information: A3 (0×07); and
Buffer-stored-paper-type information: plain paper 1 (0×01).

The buffer assignment control is initiated in response to detection of an exchange of printing paper decks or a change of printing paper stored in printing paper deck, that is, occurrence of a difference in relationship between the printing-paper-deck managing data and the feeding-buffer-apparatus managing data.

Figure 8:
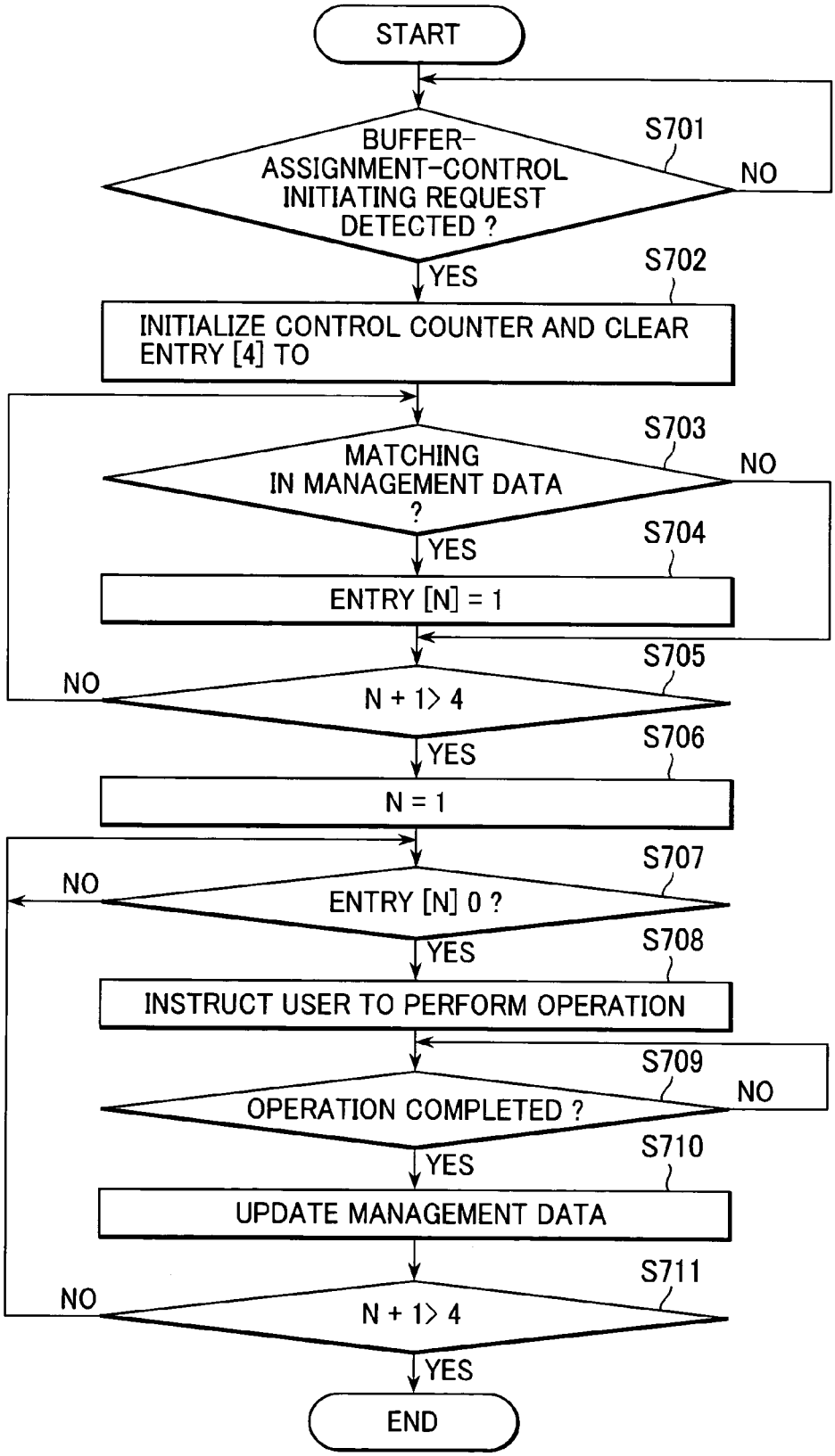
FIG. 8 is a flowchart showing a sequence for feeding-buffer-tray assignment.

Next, the feeding buffer assignment control is described below with reference to the flowchart shown in FIG. 8.

In step S701, it is determined whether a buffer-assignment-control initiating request is detected. If it is determined that the buffer-assignment-control initiating request is detected, the process proceeds to step S702.

In step S702, a control counter N (in which the maximum value is the number of printing paper decks and is set to 4 in this embodiment) for sequentially checking the printing paper decks 1200*a* to 1200*d* is initialized to one, and management data ENTRY [4] for checking the existence of a feeding buffer tray for the printing paper deck corresponding to the value of the control counter N is all cleared to zeroes.

In step S703, it is determined whether there is a feeding buffer tray having feeding-buffer-apparatus managing data which matches the printing-paper-deck managing data of the N-th printing paper deck. If there is the feeding buffer tray, the process proceeds to step S704. If there is not the feeding buffer tray, the process proceeds to step S705. In step S704, since the assignment is finished, "1" is set in the management data ENTRY [N], and the process proceeds to step S705.

In step S705, if checking of the printing paper decks 1200*a* to 1200*d*, which correspond to the value of the control counter N, has not finished, the process proceeds to step S703. If the checking has finished, the process proceeds to step S706. In step S706, the control counter N is initialized to "1". If it is determined in step S707 that the management data ENTRY [N] is zero, the process proceeds to step S708. If it is determined in step S707 that the management data ENTRY [N] is "1", the process proceeds to step S710.

In step S708, in order to assign the printing paper deck corresponding to the value of the control counter N to a feeding buffer tray for which no printing paper deck is set, by using a display section in an operation unit of the feeding buffer apparatus (described later), the user is instructed to perform an operation of removing printing paper in the corresponding feeding buffer tray. The process proceeds to step S709. When the user's operation is completed in step S709, the process proceeds to step S710.

In step S710, the printing-paper-deck managing data of the printing paper deck corresponding to the value of the control counter N is updated to change to the management data of the feeding buffer tray for which the printing paper deck is assigned. The process proceeds to step S711. In step S711, it is determined whether assignment of the printing paper decks to all the paper feeding decks has ended. If the assignment has not ended, the process returns to step S707. If the assignment has ended, the assignment control ends.

Feeding Buffering Control

Next, the feeding buffering control is described below.

In the Case of Storing Printing Paper in Assigned Feeding Buffer Tray

Control for storing a predetermined amount of printing paper from the printing paper decks 1200*a* to 1200*d* into the feeding buffer trays 1306 to 1309 (assigned in the feeding buffer assignment control) of the feeding buffer apparatus 1300 is described below.

During the job operation, the image forming apparatus 100 requests the feeding buffer trays 1306 to 1309 in the feeding buffer apparatus 1300 to feed printing paper, and the feeding buffer trays 1306 to 1309 feed printing paper to the image forming apparatus 100. When the remaining-amount detecting sensor S2 detects a decrease in the remaining sheet amount in each feeding buffer tray from a predetermined amount, a feeding buffering operation from a printing paper deck for paper feeding is performed asynchronously with a paper feeding operation to the image forming apparatus 100, and the feeding buffering operation is performed until the amount of printing paper in the feeding buffer tray reaches the predetermined value.

As described above, when the printing paper stored in the sheet deck assembly 1200 during the image forming operation, printing paper which is stored beforehand in the feeding buffer trays 1306 to 1309 in the feeding buffer apparatus 1300 is fed to the image forming apparatus 100. At the time that the remaining amount of printing paper in the feeding buffer trays 1306 to 1309 reaches a predetermined value, printing paper is supplied from the printing paper decks 1200*a* to 1200*d* to the feeding buffer trays 1306 to 1309 until its amount reaches a predetermined value, asynchronously with the paper feeding operation to the image forming apparatus 100.

In addition, by providing a feeding buffer function to store a small percentage of all of the printing paper in the printing paper decks 1200*a* to 1200*d*, and using the feeding buffer function to asynchronously perform the paper feeding from the feeding buffer apparatus 1300 to the image forming apparatus 100 and the paper feeding from the printing paper decks 1200*a* to 1200*d* to the feeding buffer apparatus 1300, control of the image forming apparatus 100 and the feeding buffer apparatus 1300 and control of the feeding buffer apparatus 1300 and the sheet deck assembly 1200 can be separately performed. This enhances the independence of control of each apparatus, so that system expansion is facilitated.

The speed of carrying printing paper from the sheet deck assembly 1200 to the feeding buffer apparatus 1300 in the case of performing the feeding buffering operation is faster than that of carrying printing paper to the image forming apparatus 100, and the speed of the feeding buffering operation is faster than that of feeding printing paper to the image forming apparatus 100. Thus, the printing paper in the feeding buffer trays 1306 to 1309 is prevented from running out.

When the above feeding buffer assignment control is performed, by pressing the initialization key 4002, an initial feeding buffering operation is initiated. The initial feeding buffering operation ends when the feeding buffer trays 1306 to 1309 store a predetermined amount of printing paper. However, even if the job starts in a state in which the initial feeding buffering operation is not completed due to no pressing of the initialization key 4002, the initial feeding buffering operation can be automatically performed before the job starts.

Figure 9:
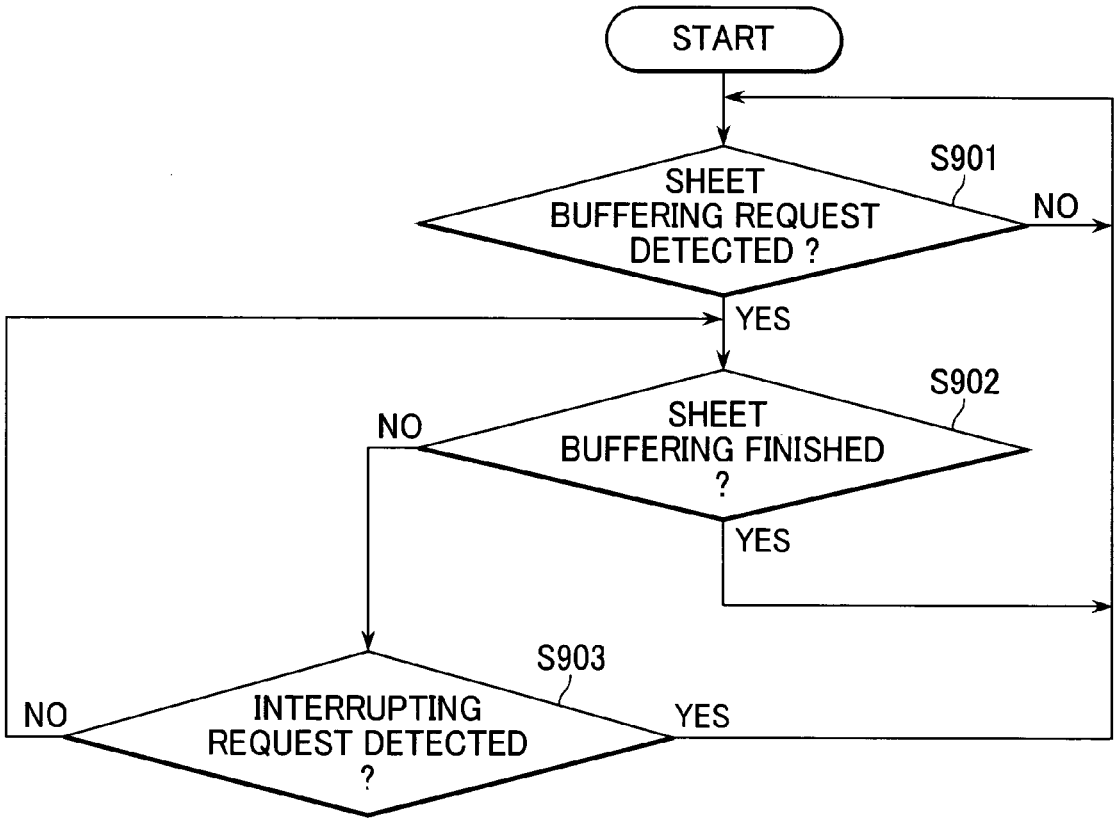
FIG. 9 is a flowchart showing a feeding buffering process in the case of feeding printing paper to an assigned feeding buffer tray.

Next, the feeding buffering control is described below with reference to the flowchart shown in FIG. 9.

In step S901, it is determined whether a feeding buffer initializing request or an in-job feeding buffer request has been detected.

In step S902, paper feeding commands are issued to the sheet deck assembly 1200 for use in buffering until printing paper in the feeding buffer trays 1306 to 1309 in the feeding buffer apparatus 1300 has a predetermined amount. the feeding buffering operation is performed from the printing paper decks 1200*a* to 1200*d* to the feeding buffer trays 1306 to 1309, which are assigned. When the feeding buffering operation ends, the process returns to step S901.

If it is determined in step S903 that there is a lack of printing paper in the printing paper deck during feeding, a jam in carriage in buffer, or the above-described feeding buffering operation interrupting request based on the pressing of the initialization key 4002 or the interruption key 4003, the feeding buffering operation is terminated, and the process returns to step S901. If no feeding buffering operation interrupting request is detected, the process returns to step S902.

Example of Feeding Buffering Control in Which Feeding Buffering is Performed in First Job As another example concerning the feeding buffering control, control in which feeding buffering is not performed in the first job is described below.

Figure 10:
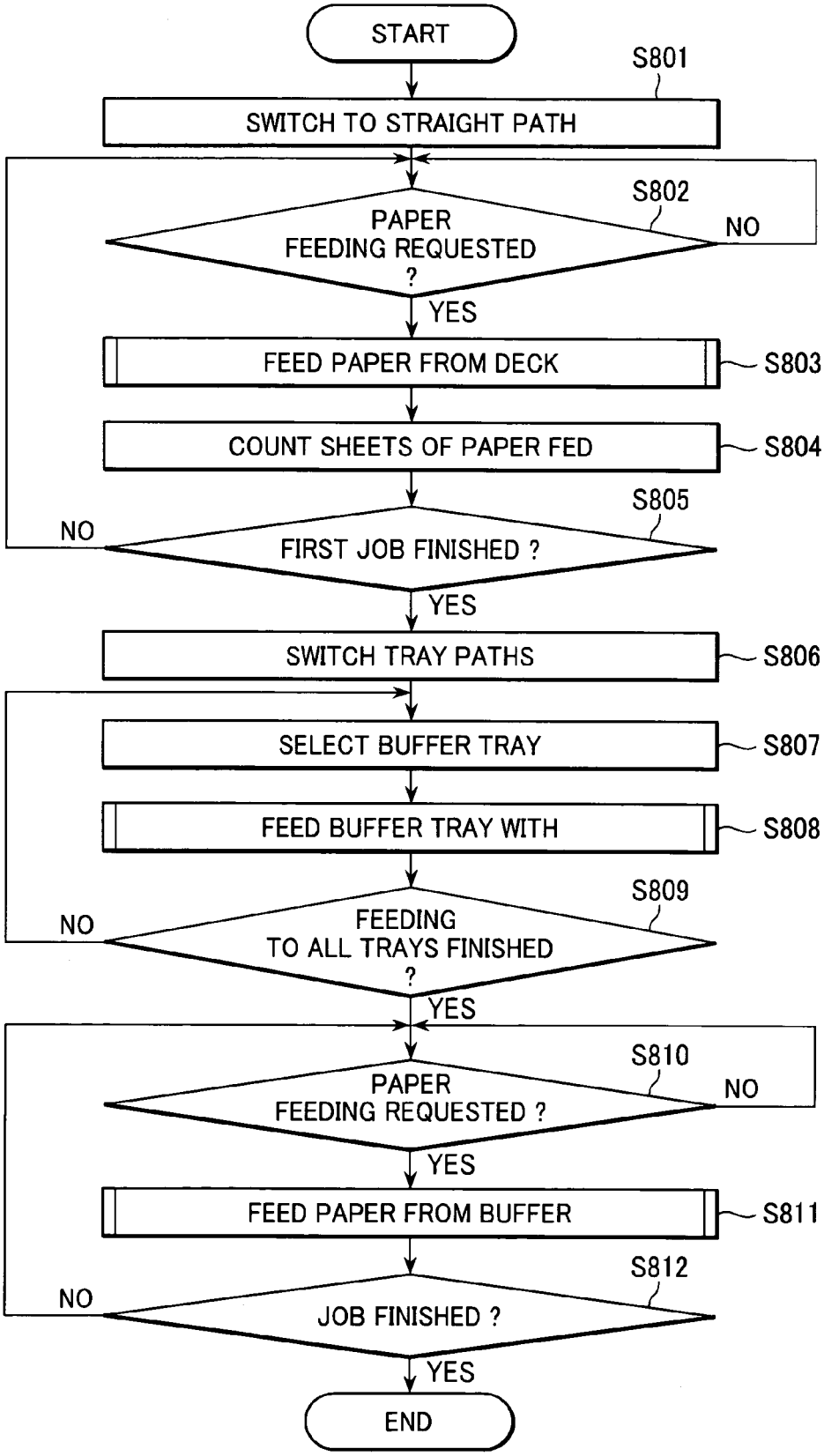
FIG. 10 is a flowchart showing a process of feeding buffering control in a case in which the first job uses no feeding buffer tray.

FIG. 10 is a flowchart showing a feeding buffering control process performed by the CPU 2301 when it receives a paper feeding command from the image forming apparatus 100.

In step S801, since the first job does not use the feeding buffer trays 1306 to 1309, the CPU 2301 sets the straight path 1304 to be usable by putting down the flapper 1303. In step S802, the CPU 2301 awaits a feeding request from the feeding buffer apparatus 1300. In step S803, the CPU 2301 feeds printing paper from the sheet deck assembly 1200. In step S804, in the feeding, the numbers of sheets of printing paper from the printing paper decks 1200*a* to 1200*d* are counted and stored.

In step S805, the CPU 2301 determines whether the first job has ended. If the first job is continuing, the CPU 2301 returns to the state of awaiting the feeding request. If the CPU 2301 has determined in step S805 that the first job has ended, in step S806, the CPU 2301 stands the flapper 1303 to switch the feeding buffer trays 1306 to 1309 to a feedable state.

After that, in step S807, the CPU 2301 selects one feeding buffer tray to be fed with printing paper, and selects one printing paper deck corresponding to the selected feeding buffer tray under the control of feeding buffer assignment control. In step S808, based on the numbers of sheets counted in step S804 for use in the first job, the sheets of printing paper required for printing the remaining sheets to be printed in the job are fed from the printing paper decks 1200*a* to 1200*d* to the feeding buffer trays 1306 to 1309. However, when the number of sheets to be fed exceeds the maximum number of sheets set in the feeding buffer trays 1306 to 1309, only the sheets for the maximum number are fed and the number of remaining sheets to be fed is stored.

In step S809, the CPU 2301 determines whether the feeding of all the feeding buffer trays 1306 to 1309 for use has ended. If the printing paper has not been fed to all the feeding buffer trays 1306 to 1309 yet, the CPU 2301 returns to step S807 and feeds the next feeding buffer tray with printing paper. If the CPU 2301 has determined in step S809 that the feeding of all the feeding buffer trays 1306 to 1309 is completed, it initiates printing for the second job. In step S810, the CPU 2301 awaits a paper feeding request. In step S811, printing paper is fed from the feeding buffer apparatus 1300 to the image forming apparatus 100. More accurately, the feeding control mechanism 1310 in the feeding buffer apparatus 1300 is controlled to feed printing paper to the image forming apparatus 100 from the feeding buffer tray corresponding to the designated printing paper deck.

Subsequently, the feeding control is repeatedly performed until the CPU 2301 determines in step S812 that the job has ended.

Although the process in FIG. 10 feeds printing paper to the feeding buffer trays 1306 to 1309 after the first job, printing paper feeding can be performed with other timing.

Figure 11:
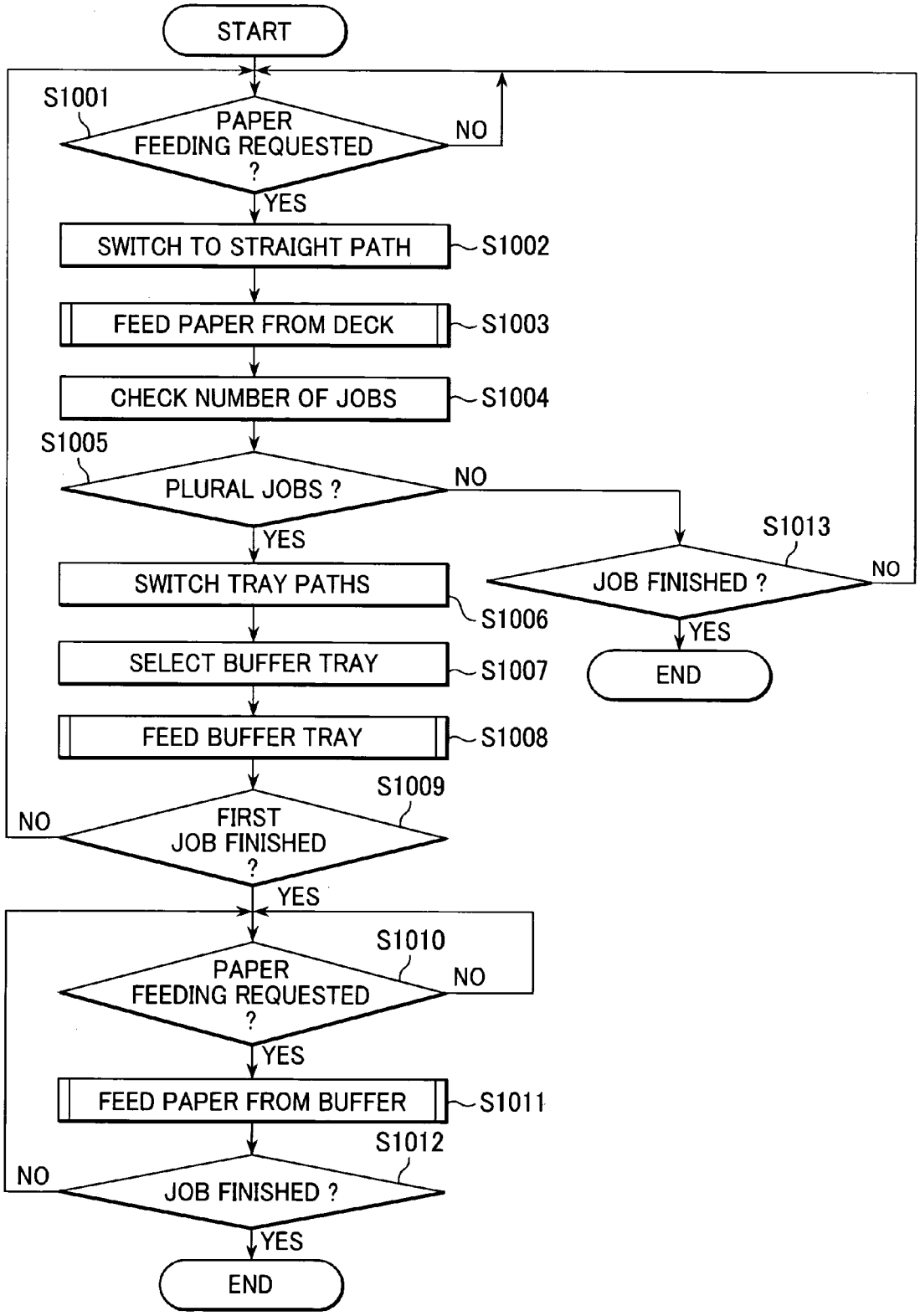
FIG. 11 is a flowchart showing a process of feeding buffering control in the case of feeding printing paper to feeding buffer trays during the operation of the first job.

FIG. 11 is a flowchart showing feeding buffering control in the case of feeding printing paper to the feeding buffer trays 1306 to 1309 during the operation of the first job. For processing as shown in the flowchart in FIG. 11, a feeding request command in the first job must include information of the number of jobs.

In step S1001, a feeding request is awaited. In step S1002, in response to the feeding request, the flapper 1303 is put down to set the straight path to be usable in order to directly feed printing paper for the first job to the image forming apparatus 100 without performing the feeding buffering operation. In step S1003, the printing paper is fed to the image forming apparatus 100 from a designated printing paper deck. In this feeding, the number of jobs is counted in step S1004.

When a plurality of jobs are detected in step S1005, the process moves to step S1006, and the flapper 1303 is lifted to switch the feeding buffer tray into a feedable state. In step S1007, under the control of the feeding buffer assignment control, a feeding buffer tray corresponding to the printing paper deck is selected. In step S1008, in order to print sheets of printing paper corresponding to the number of remaining jobs counted in step S1004, the required number of sheets of printing paper is fed from the printing paper deck to the feeding buffer tray. However, when the number of sheets to be fed exceeds a maximum limit set for the feeding buffer tray, only the sheets for the maximum number are fed and the number of remaining sheets to be fed is stored.

In step S1009, it is determined whether the first job has finished. If the first job is not finished and continued to be performed, the process returns to step S1001, and the next feeding request is awaited. If it is determined in step S1009 that the first job has finished, printing for the second job is initiated. In step S1010, a feeding request is awaited. In response to the feeding request, in step S1011, printing paper is fed from the feeding buffer tray to the image forming apparatus 100.

Subsequently, the above feeding control is repeatedly performed until a job end is determined in step S1012.

If it is determined in step S1005 that the number of jobs is one, then in step S1013 it is determined whether the first job has finished. If the first job has not finished yet, the process returns to step S1001, and the process ends when the first job finishes.

Figure 12:
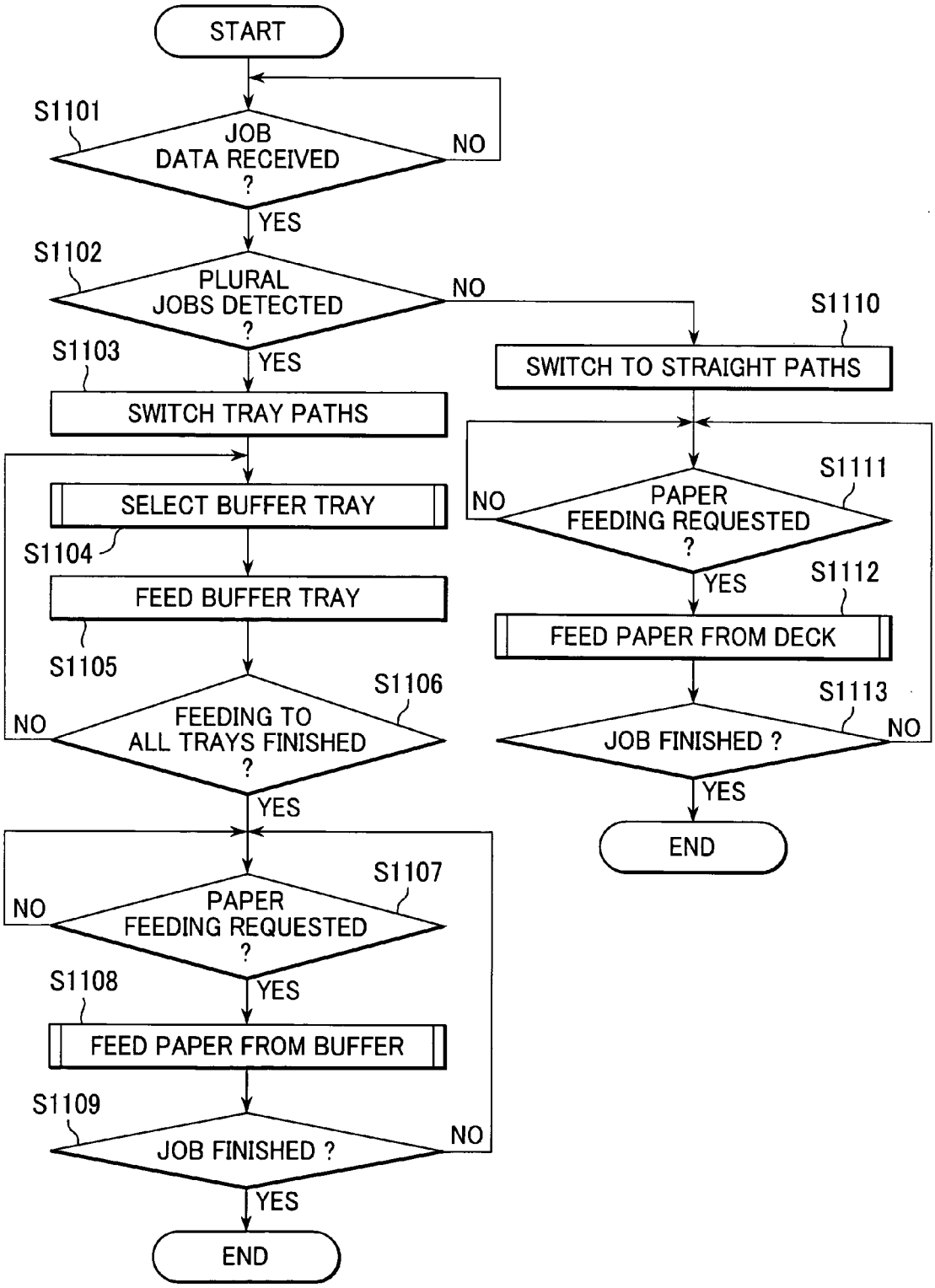
FIG. 12 is a flowchart showing a process of feeding buffering control in the case of supplying sheets of printing paper to feeding buffer trays before the operation of the first job starts.

FIG. 12 is a flowchart showing feeding buffering control in the case of supplying sheets of printing paper to the feeding buffer trays 1306 to 1309 before the operation of the first job starts. Processing as shown in the flowchart shown in FIG. 12 requires a mechanism that detects the number sheets of printing paper for use in the job for each of the printing paper decks 1200*a* to 1200*d*.

In this case, in step S1101, it is determined whether job data is received. In other words, transmission of job data is awaited. The job data includes the numbers of sheets for use in the printing paper decks 1200*a* to 1200*d*. If it is determined in step S1102 that the job data represents plural jobs, the process proceeds to step S1103. If it is determined in step S1102 that the job data represents a single job, the process proceeds to step S1110. In step S1103, in order to feed the feeding buffer trays 1306 to 1309 with printing paper, the flapper 1303 is lifted to set the feeding buffer trays 1306 to 1309 to be feedable.

In step S1104, a feeding buffer tray to be fed with printing paper is selected, and one printing paper deck for the selected feeding buffer tray is selected under the control of the feeding buffer assignment control. In step S1105, the sheets of printing paper required for the job are fed from the printing paper deck to the feeding buffer tray. However, when the number of sheets fed exceeds a maximum number of sheets, sheets for the maximum limit are fed and the number of remaining sheets is stored.

In step S1106, it is determined whether feeding of the printing paper to all the feeding buffer trays 1306 to 1309 for use has finished. If the feeding of the printing paper to all the feeding buffer trays 1306 to 1309 has not finished yet, the process returns to step S1104 and feeds the next feeding buffer tray.

If it is determined in step S1006 that the feeding of the printing paper to all the feeding buffer trays 1306 to 1309 is completed, a printing operation for the job is initiated. In step S1107, it is determined whether paper feeding is requested. In other words, the paper feeding is awaited. In step S1008, the printing paper is fed from the feeding buffer trays 1306 to 1309 to the image forming apparatus 100.

Subsequently, the feeding control is repeatedly performed until it is determined in step S1109 that the job has finished.

If it is determined in step S1102 that the job data represents one job, then in step S1110 the flapper 1303 is put down to set the straight path 1304 to be usable in order to feed the printing paper to the image forming apparatus 100 without storing the printing paper in any feeding buffer tray.

A printing operation for the job is initiated. In step S1111, it is determined whether feeding of printing paper is requested. In other words, the feeding of printing paper is awaited. In step S1112, the printing paper is fed from the printing paper decks 1200*a* to 1200*d* to the image forming apparatus 100 through the straight path 1304.

Subsequently, the feeding control is repeatedly performed until it is determined in step S1113 that the job has finished.

Example of Feeding Buffering Control Having Two Modes

Example control having two modes is described as another example of feeding buffering control.

Figure 13:
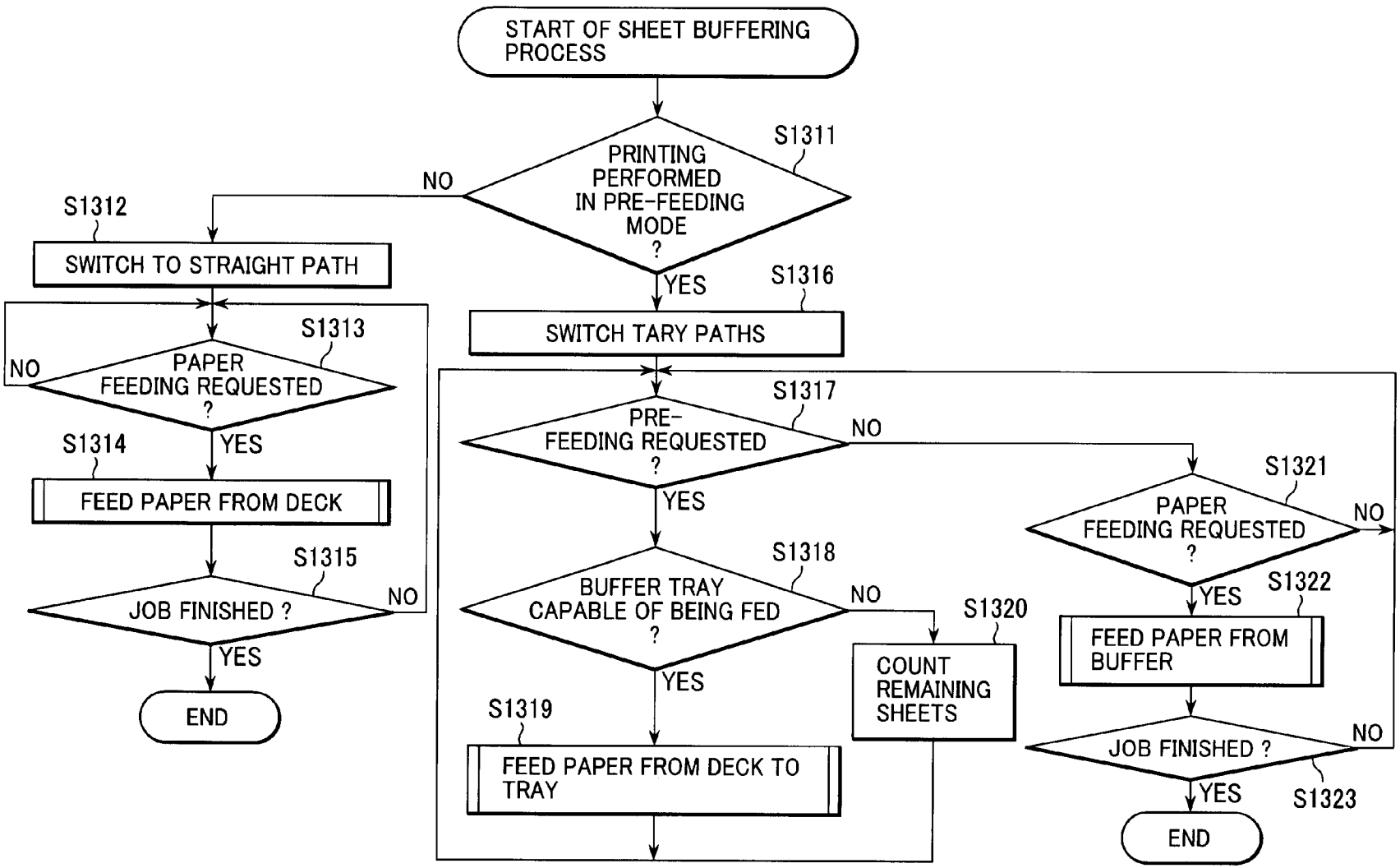
FIG. 13 is a flowchart showing a feeding buffering control process using two modes.

FIG. 13 is a flowchart showing a feeding buffering control performed by the CPU 2301 in the feeding buffer apparatus 1300 in response to a paper feeding command from the image forming apparatus 100.

In step S1311, it is determined whether a pre-feeding mode which is a first mode in the present invention is used for printing. The pre-feeding mode is an operation mode in which a feeding interval is longer than that in a normal mode, which normal mode corresponds to a second mode in the present invention. In the pre-feeding mode, the image forming apparatus 100 has a productivity lower than that in the normal mode. In a double-sided mode, alternate image formation is performed on sheets fed from the printing paper decks 1200*a* to 1200*d* and on sheets of printing paper from the re-feeding tray 156. Thus, a feeding interval from the printing paper decks 1200*a* to 1200*d* is doubled. In a glossy paper mode, to fix toner on a sheet of glossy paper, more heat is required. Thus, an image forming operation is performed with the process speed reduced. Accordingly, the feeding interval is longer than that in the normal mode.

In the pre-feeding mode, separately from a feeding request for feeding printing paper from the feeding buffer apparatus 1300 to the image forming apparatus 100, the image forming apparatus 100 issues a pre-feeding request for feeding printing paper from the sheet deck assembly 1200 to the feeding buffer apparatus 1300. The pre-feeding request is issued asynchronously with the image forming operation. For example, the pre-feeding request is issued at the time that the size of printing paper to be printed and the type of printing paper are set in the process of expanding printing image data into raster image data in the formatting section 504. In other words, the feeding of printing paper from the feeding buffer trays 1306 to 1309 to the feeding buffer apparatus 1300, and the feeding of printing paper from the printing paper decks 1200*a* to 1200*d* to the feeding buffer trays 1306 to 1309 are asynchronously performed at different times.

If it is determined in step S1311 that the pre-feeding mode is not used, the flapper 1303 is moved to set the straight path 1304 to be usable (step S1312).

Subsequently, in step S1313, it is determined whether feeding of printing paper is requested. In other words, a paper feeding request is awaited. In step S1314, in response to the paper feeding request, printing paper is fed from a designated one of the printing paper decks 1200*a* to 1200*d* to the image forming apparatus 100 through the straight path 1304. If it is determined in step S1315 that the job has not finished, the process returns to a state of awaiting the feeding request. If it is determined in step S1315 that the job has finished, the feeding buffering process ends.

If it is determined in step S1311 that the pre-feeding mode is used, the flapper 1303 is lifted and the feeding buffer trays 1306 to 1309 are switched to be usable. In step S1317, a pre-feeding request is awaited, and in step S1321, a feeding request is awaited.

If it is determined in step S1317 that the pre-feeding request has been received, then in step S1318 it is determined whether the corresponding feeding buffer tray is in a state capable of feeding. Each feeding buffer tray has a maximum limit of sheets that can be stored. When the number of sheets stored reaches the maximum limit, more sheets of printing paper cannot be fed. If it is determined in step S1318 that the feeding buffer tray can be fed, in step S1319, printing paper is fed from a printing paper deck for the pre-feeding request, and is supplied from the printing paper deck to the feeding buffer tray.

If it is determined in step S1318 that the feeding buffer tray cannot be fed, then in step S1320 a remaining sheet counter for the designated printing paper deck is incremented and the number of remaining sheets is stored. If it is determined in step S1321 that the feeding request is received, in step S1322, the feeding control mechanism 1310 is controlled to feed the printing paper from a feeding buffer tray corresponding to the designated printing paper deck to the image forming apparatus 100. If it is determined in step S1323 that the job has not finished yet, the process returns to the state of awaiting the pre-feeding request in step S1317 or the state of awaiting the feeding request. If it is determined in step S1323 that the job has finished, the process ends. Although, in this embodiment, switching between the normal mode and the pre-feeding mode is set based on a low productivity operation, the present invention is not limited to that setting, but the switching may be set in accordance with a job type, the operation of a post-process, etc., if needed.

Example of Feeding Buffering Control in Which Sheets of Printing Paper Are Stored in Feeding Buffer Tray in Order of Images to be Formed Another example of the feeding buffering control is described below in which sheets of printing paper in the printing paper decks 1200*a* to 1200*d* are stored in the feeding buffer trays 1306 to 1309 in the feeding buffer apparatus 1300 in order of images to be formed.

The storage of the sheets in order of images to be formed is that, when image formation is performed on sheets of printing paper of various types stored in the printing paper decks 1200*a* to 1200*d*, and printed sheets are output from the image forming system, with a predetermined number of sheets formed as a set, sheets of printing paper fed from the printing paper decks 1200*a* to 1200*d* are stored as a bundle in the feeding buffer trays 1306 to 1309 in accordance with order of images formed. The sheets are fed from the bundle to the image forming apparatus 100 for image formation.

In addition, when the image forming system outputs a plurality of identical sets of sheets of printing paper, sheets of printing paper to be stored in order of images to be formed are stored as bundles in the feeding buffer trays 1306 to 1309, and are fed in the order of images to be formed from the feeding buffer trays 1306 to 1309. One of the feeding buffer trays 1306 to 1309 may store a plurality of bundles of sheets of printing paper in order of images to be formed.

As described above, in a case in which bundles of sheets of printing paper are stored in the feeding buffer trays 1306 to 1309, when a full-storage detecting sensor (not shown) in each feeding buffer tray detects full storage of printing paper, the operation of feeding the feeding buffer tray is stopped. After a predetermined amount of printing paper is fed from the feeding buffer trays 1306 to 1309 to the image forming apparatus 100, paper feeding to the feeding buffer trays 1306 to 1309 is restarted.

A sheet carrying speed from the printing paper decks 1200*a* to 1200*d* to the feeding buffer apparatus 1300 in the case of performing the feeding buffering operation is greater than a sheet feeding speed to the image forming apparatus 100, and the speed of the feeding buffering operation is greater than the sheet feeding speed to the image forming apparatus 100. Thus, the sheets of printing paper in the feeding buffer trays 1306 to 1309 are prevented from running out.

Figure 15:
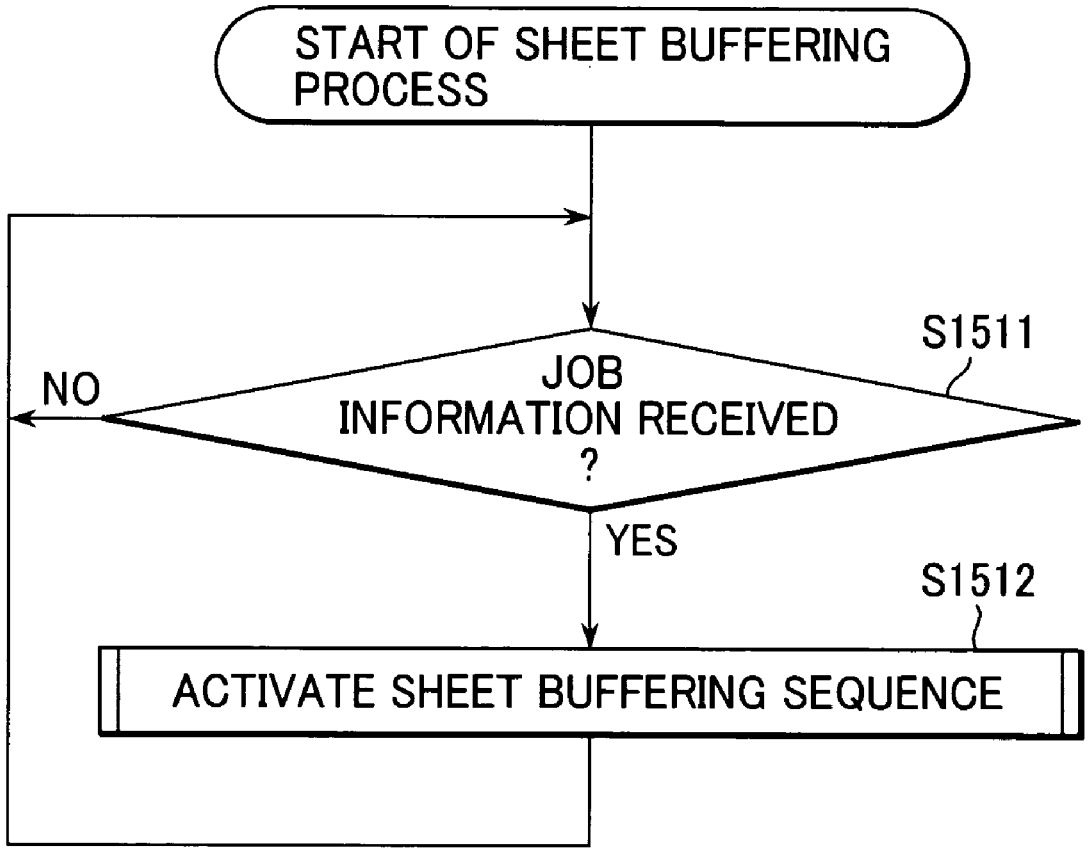
FIG. 15 is a flowchart showing an operation control process in an example of feeding buffering control in which sheets of printing paper are stored in a feeding buffer tray in order of images to be formed.

FIG. 15 is a flowchart showing operation control in the feeding buffering control.

In step S1511, it is determined whether job information has been received from the image forming apparatus 100. Step S1511 is repeatedly performed until the job information is received. The job information is feeding information transmitted from the image forming apparatus 100 to the feeding buffer apparatus 1300 for each job. The job information includes the number of sheets (of printing paper) forming one bundle of sheets, information of the number of bundles of sheets, and information of a printing paper deck for feeding printing paper. After the job information is received, then in step S1512 a sheet buffering sequence is activated to start paper feeding to the feeding buffer tray, and the process returns to step S1511 again. The sheet buffering sequence is activated whenever the job information is received, and performs parallel processing.

Figure 16:
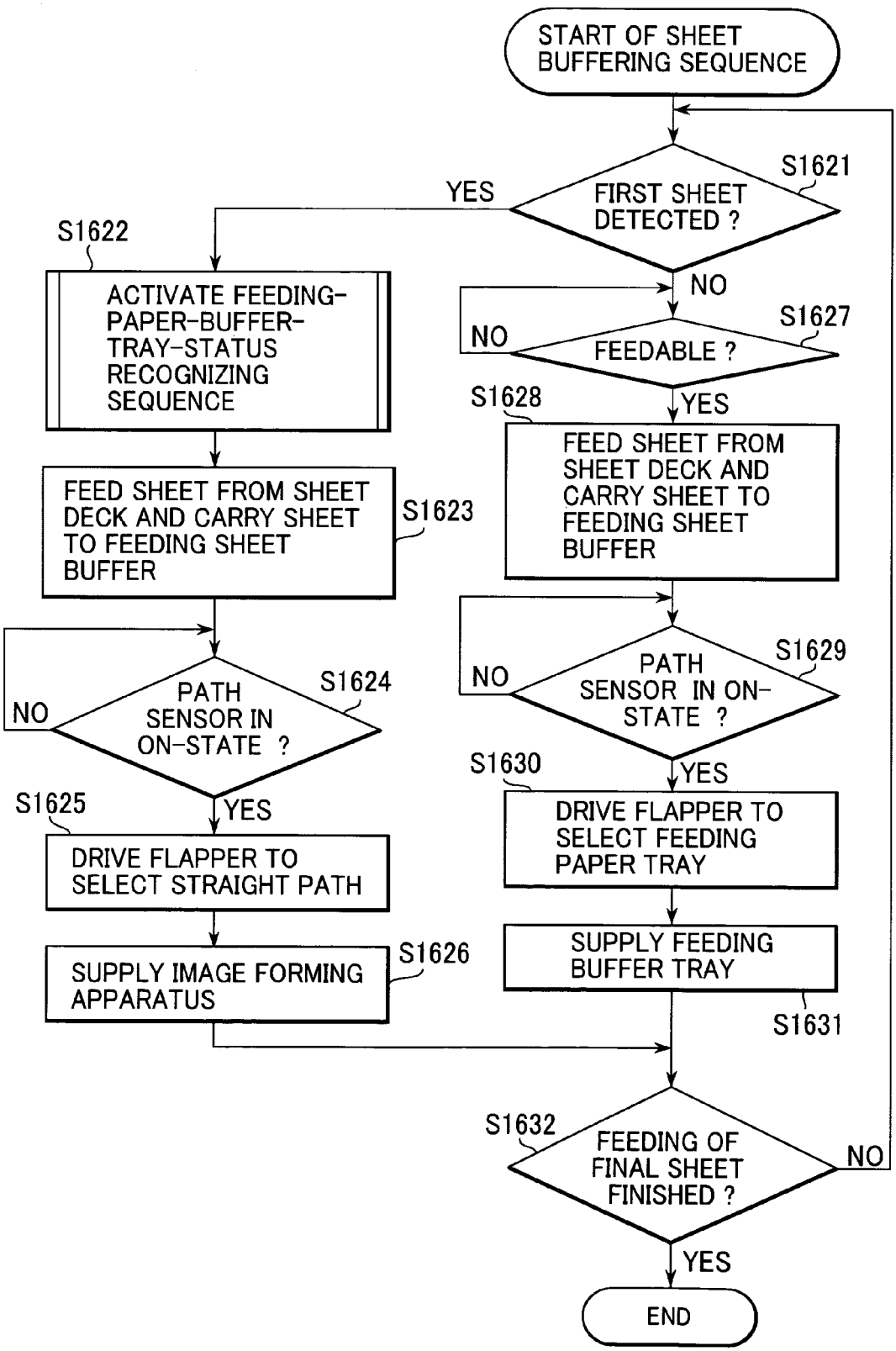
FIG. 16 is a flowchart showing a feeding buffering control process in the case of storing sheets of printing paper in a feeding buffer tray in order of images to be formed.

FIG. 16 is a flowchart of the sheet buffering sequence which shows the operation of feeding printing paper from the sheet deck assembly 1200 to the feeding buffer trays 1306 to 1309 or to the image forming apparatus 100 in the feeding buffering control.

In step S1621, it is determined whether a first sheet of printing paper to be fed is detected. If it is affirmatively determined in step S1621, then in step S1622 a feeding-buffer-tray-status recognizing sequence is activated. In the feeding-buffer-tray-status recognizing sequence, parallel processing is performed with the feeding buffering sequence. In step S1623, printing paper is fed from a designated printing paper deck and is carried to the feeding buffer apparatus 1300. In step S1624, it is determined whether a path sensor (not shown) provided on the upstream side in the carrying direction from the flapper 1303 is switched on. Step S1624 is repeatedly performed until the path sensor is switched on. If it is determined that the path sensor is switched on, in step S1625, the flapper 1303 is driven to select the straight path 1304. In step S1626, the sheet is fed to the image forming apparatus 100. In step S1632, it is determined whether feeding of the final sheet in the job has finished. If the feeding of the final sheet in the job has finished, the sheet buffering sequence ends. If the feeding of the final sheet in the job has not finished, the sheet buffering sequence returns to step S1621. By directly carrying the first sheet of printing paper to the image forming apparatus 100 without using the feeding buffer trays 1306 to 1309, an advantage is obtained in that a first copy output time (FCOT) decreases.

If it was determined in step S1621 that the first sheet was not detected, then in step S1627 it is determined whether each printing paper deck is in a state capable of feeding printing paper. Step S1627 is repeatedly performed until the printing paper deck is in the state capable of feeding printing paper. The state capable of feeding printing paper is determined by the storage states of the feeding buffer trays 1306 to 1309 which are recognized in the feeding-buffer-tray-status recognizing sequence, or by the position of a sheet of printing paper having prior image-forming order compared with a reference sheet of printing paper. If it is determined that the printing paper deck is in the state capable of feeding printing paper, in step S1628, printing paper is fed from the designated printing paper deck and is carried to the feeding buffer apparatus 1300.

In step S1629, it is determined whether the path sensor is switched on. Step S1629 is repeatedly performed until the path sensor is switched on. If it is determined in step S1629 that the path sensor is switched on, in step S1630, the flapper 1303 is driven to select the paper feeding switching mechanism 1305. In step S1631, the printing paper is fed to the feeding buffer trays 1306 to 1309, and the sheet buffering sequence ends.

The feeding of printing paper from the feeding buffer trays 1306 to 1309 is sequentially performed as requested by the image forming apparatus 100. As described above, in a case in which, by divisionally performing the operation of feeding the image forming apparatus 100 and the operation of feeding the feeding buffer tray, one set of imaged sheets of printing paper of various types is output from the image forming system, paper feeding may be controlled so that the image forming apparatus 100 may be always fed with printing paper from one feeding buffer tray differently from feeding of the image forming apparatus 100 with printing paper from each printing paper deck, which is positioned away from the image forming apparatus 100, so that carriage control is simplified and reliability is enhanced.

In addition, the feeding of printing paper from the feeding buffer apparatus 1300 to the image forming apparatus 100 and the feeding of printing paper from the printing paper decks 1200*a* to 1200*d* to the feeding buffer apparatus 1300 are asynchronously performed. The above asynchronous control enables separate implementation of control of the image forming apparatus 100 and each feeding buffer tray, and control of each feeding buffer tray and each printing paper deck, so that high independency of controlling each apparatus is obtained, thus facilitating system expansion.

Regarding the feeding (sheet buffering operation) of printing paper from the printing paper decks 1200*a* to 1200*d* to the feeding buffer trays 1306 to 1309, after sheets of printing paper are fed from each printing paper deck in order of images to be formed by the image forming apparatus 100, in each feeding buffer tray, bundles of sheets in order of the images may be stored. Also, in such a manner of consecutively feeding each of the feeding buffer trays 1306 to 1309 with printing paper from one printing paper deck storing the first sheet in order of image formation in the printing paper decks 1200*a* to 1200*d*, and consecutively feeding each of the feeding buffer trays 1306 to 1309 with printing paper from one printing paper deck storing the second sheet, by feeding identical sheets of printing paper to the feeding buffer trays 1306 to 1309 in order of image formation, bundles of sheets in order of image formation may be finally stored in the feeding buffer trays 1306 to 1309.

Feedable State Recognizing Sequence

Figure 17:
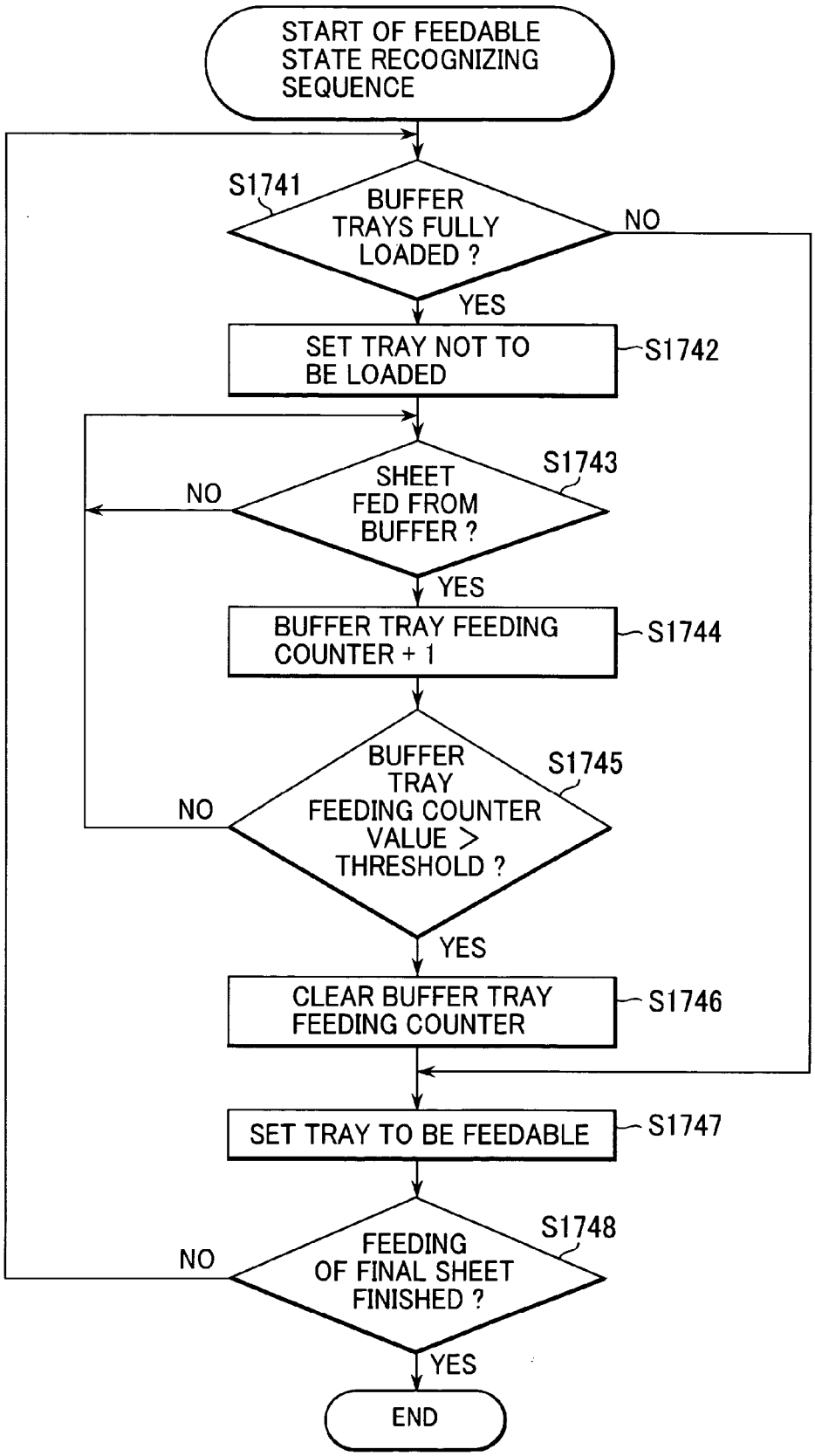
FIG. 17 is a flowchart showing a feedable state recognizing sequence which monitors the storage states of feeding buffer trays.

FIG. 17 is a flowchart of a feedable state recognizing sequence which monitors the storage states of the feeding buffer trays 1306 to 1309 and which determines whether each feeding buffer tray can be fed with printing paper from the printing paper decks 1200*a* to 1200*d*.

In step S1741, it is determined whether a full-storage detecting sensor (not shown) provided in each of the feeding buffer trays 1306 to 1309 detects full storage of printing paper (the remaining-amount detecting sensor S2 may detects full storage). When the full storage is detected, in step S1742, the feeding buffer tray is set not to be fed with printing paper. In step S1743, it is determined whether the printing paper is fed from the feeding buffer trays 1306 to 1309. Step S1743 is repeatedly performed until the printing paper is fed from the feeding buffer trays 1306 to 1309.

When the printing paper is fed from the feeding buffer trays 1306 to 1309, then in step S1744 the value of a buffer tray feeding counter is incremented by one. In step S1745, it is determined whether the value of the buffer tray feeding counter is greater than a threshold value. If it is determined in step S1745 that the value of the buffer tray feeding counter is not greater than the threshold value, the feedable state recognizing sequence returns to step S1743.

If it is determined in step S1745 that the value of the buffer tray feeding counter is greater than the threshold value, then in step S1746 the buffer tray feeding counter is cleared. In step S1747, the feeding buffer tray is set to be feedable.

A targeted value of the buffer tray feeding counter in step S1745 can be arbitrarily changed, and is determined based on a value such as the number of sheets that can be stored in the feeding buffer tray.

In step S1748, it is determined whether feeding of the final sheet of printing paper from the printing paper deck has finished. When the feeding has finished, the feedable state recognizing sequence ends. If it is determined in step S1748 that the feeding of the final sheet has not finished yet, the feedable state recognizing sequence returns to step S1741.

Control in the No Printing Paper in Printing Paper Deck

Next, an operation for the occurrence of the no-paper state of the printing paper deck during a job in the image forming system of the present invention is described below.

In the image forming system of the present invention, even if a no-paper state of each printing paper deck occurs during the operation of the job, an image forming operation can be continuously performed until printing paper in the feeding buffer tray runs out since a predetermined amount of printing paper is stored in the feeding buffer trays 1306 to 1309 in the feeding buffer apparatus 1300.

Accordingly, when the above-described Level 1 (state in which the feeding buffer tray has printing paper and the printing paper deck has no printing paper) occurs, by providing means of informing the user in such a manner that the message display portion 4001*f* in the operation unit 2307 of the feeding buffer apparatus 1300 displays a message instructing the user to supply printing paper to the printing paper deck having no printing paper, the user can supply printing paper before the image forming system halts due to no-paper state. This can prevent the system halt from occurring.

Figure 18:
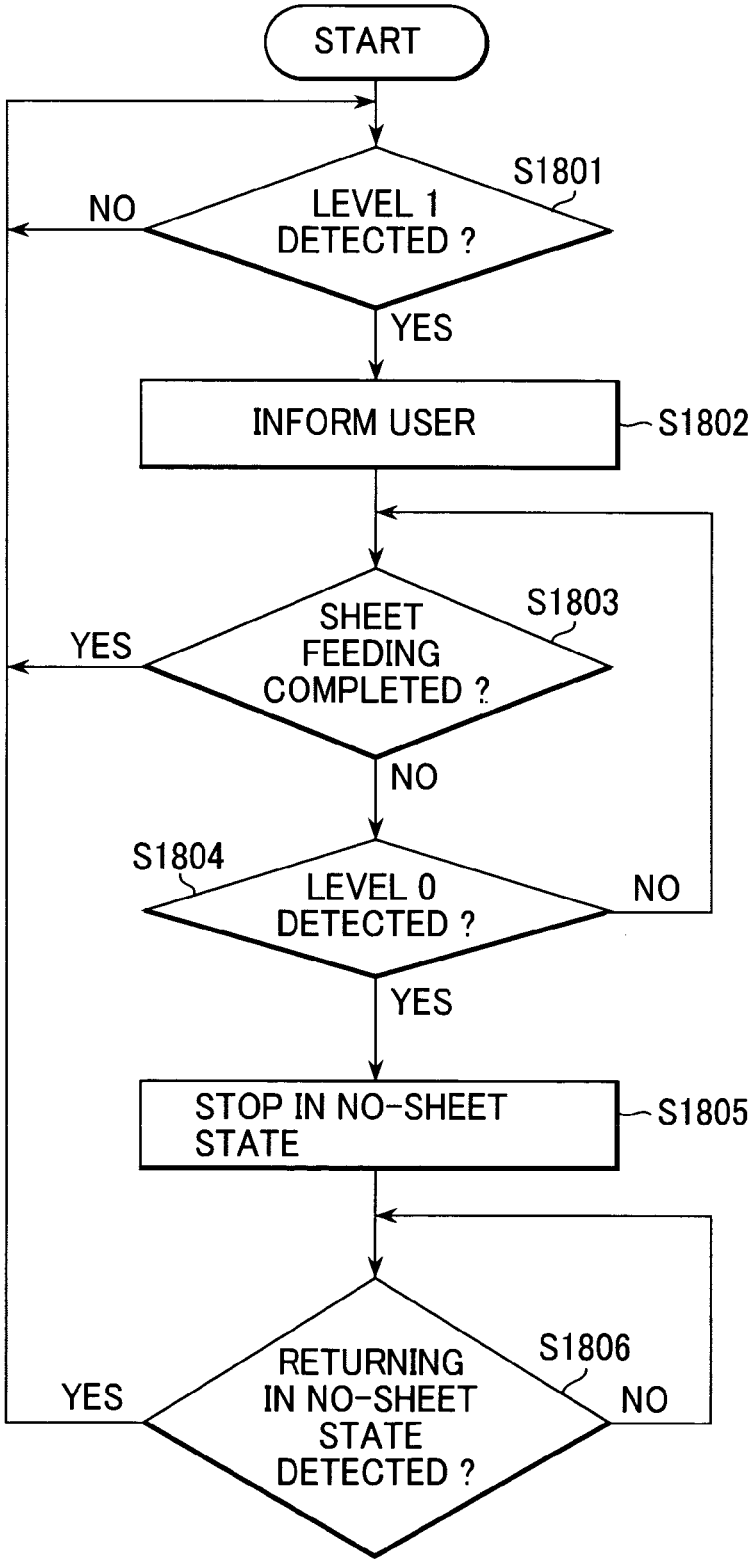
FIG. 18 is a flowchart showing a process for the occurrence of a no-paper state.

A process for the occurrence of the no-paper state is described below with reference to the flowchart shown in FIG. 18.

In step S1801, it is determined whether Level 1 is detected. When Level 1 is detected, the process proceeds to step S1802.

In step S1802, a message instructing the user to supply printing paper to the printing paper decks 1200*a* to 1200*d* is displayed. The user presses the interruption key 4003 to prohibit the feeding buffering operation, and supplies printing paper. After finishing supplying the printing paper, the user presses the interruption key 4003 again to permit the feeding buffering operation.

In step S1803, it is determined whether printing paper supplying is completed. In other words, completion of supplying printing paper is awaited. If it is determined in step S1804 that Level 0 occurs in a state of awaiting completion of supplying printing paper, the process proceeds to step S1805. When the completion of supplying printing paper is detected before Level 0 occurs, the process returns to step S1801. In step S1805, the image forming system is stopped due to lack of printing paper. In step S1806, the image forming system waits for its status to return from the no-paper state. When the image forming system returns from the no-paper state, the process proceeds to step S1801.

As described above, by providing a mechanism of detecting the remaining amount of printing paper in each of the printing paper decks 1200*a* to 1200*d* and the feeding buffer trays 1306 to 1309 in the feeding buffer apparatus 1300, even if printing paper in each printing paper deck runs out, the job can be continued until printing paper in the feeding buffer trays 1306 to 1309 runs out. Accordingly, before the printing paper in the feeding buffer trays 1306 to 1309 runs out, a display screen of an operation unit or the like is used to inform the user of a lack of printing paper in each printing paper deck, and the user supplies printing paper, whereby the occurrence of a job interruption due to lack of printing paper can be reduced, so that the usability can be improved.

Buffering Function Limiting Control

Figure 24:
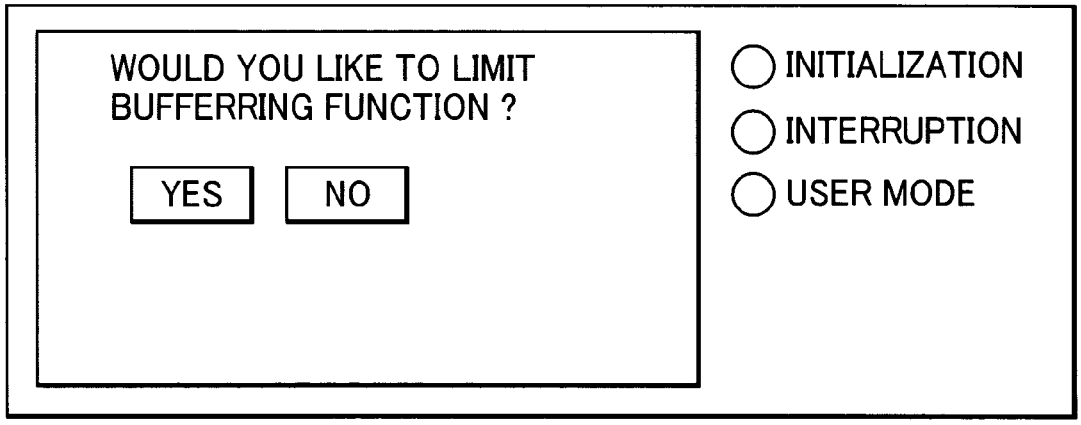
FIG. 24 is an illustration of an operation screen for directing buffering limiting control.
Figure 25:
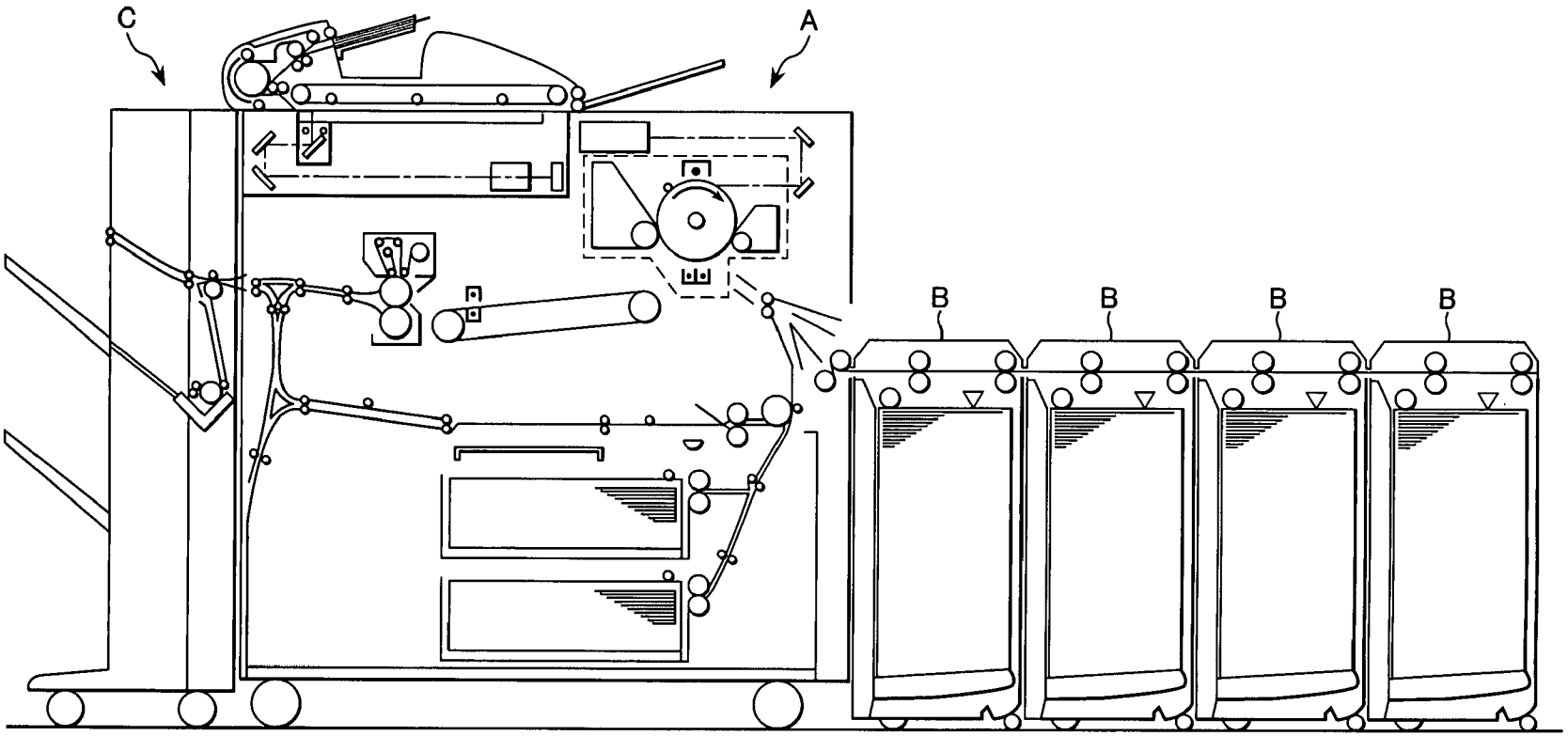
FIG. 25 PRIOR ART
FIG. 25 is a cross-sectional view showing an example of a conventional image forming system.

Referring back to FIG. 7, by pressing a user mode key 4004, the displayed screen as shown in FIG. 7 can be switched to an operation screen as shown in FIG. 24 for directing buffering limiting control. For example, when many paper jams occur in feeding from the feeding buffer trays 1306 to 1309 in the feeding buffer apparatus 1300, many errors related to feeding buffer trays occur, or a problem, such as malfunction of the feeding buffer apparatus 1300, occurs, the user uses the above screen to set buffering function limitation in accordance with instructions of a service person, whereby buffering function limiting control using non-buffering carriage control can be initiated (buffering-function-limitation directing means). When the buffering function is limited, error detection in feeding buffer tray and initialization are not performed. Settings of the buffering function limitation can be stored in a backup RAM, even if its power is switched off.

After the problem in buffering function is eliminated by a service person's repair, by releasing the buffering function limitation, the normal state is returned from the function-limited state.

After the buffering function limitation is directed, the message display portion 4001*f* in the operation unit 2307 in FIG. 7 alternately displays the messages "Limiting Buffering Function" and "Call Service Person". Accordingly, it is ensured that the user can be informed that the image forming system is operating in function-limited state (function-limiting indicating means).

Figure 19:
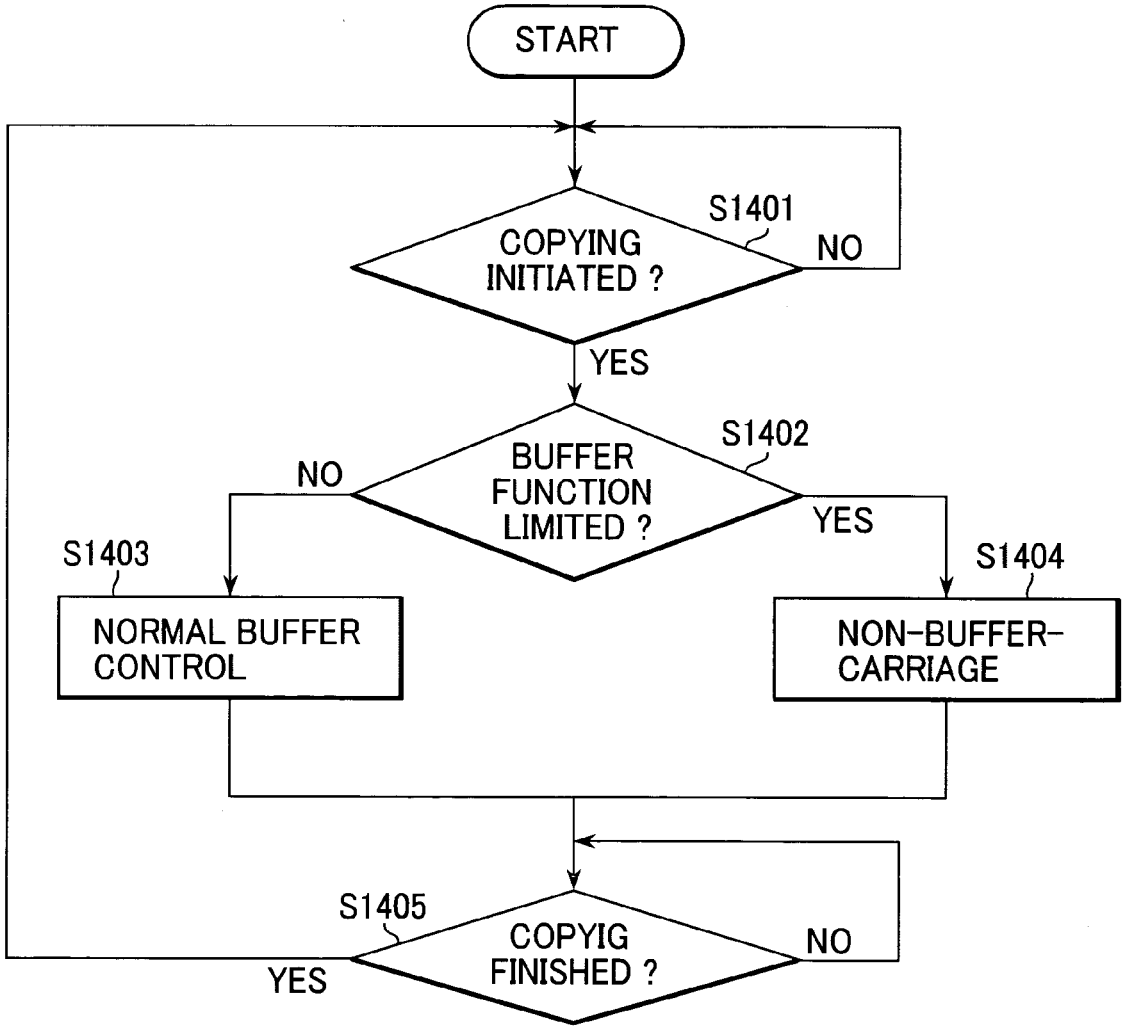
FIG. 19 is a flowchart showing an operation of the image forming system (shown in FIG. 1) in buffering-function-limited state.

Next, the operation of the image forming system in buffering-function-limited state is described below with reference to the flowchart shown in FIG. 19.

In step S1401, it is determined whether copying is initiated. When the copying is initiated, the process proceeds to step S1401. In step S1402, it is determined whether the buffering function is limited based on buffering-function-limiting information set by the buffering-function-limitation directing means. When the buffering-function limitation is not set, the process proceeds to step S1403, and the image forming system operates under the above-described feeding buffering control. When the buffering-function limitation is set, the process proceeds to step S1404, and the image-forming system operates under the non-buffering carriage control. While the image forming system is operating, even if the setting information changes, the image forming system can operate based on setting information at the start of copying.

In step S1405, the process waits for the copying to finish. When the copying finishes, the process returns to step S1401.

In the above-described control, all the buffering functions of the feeding buffer apparatus 1300 are limited, and after the buffering-function limitation is set, the image forming system operates in a non-buffering carriage mode in which no printing paper is stored in the printing paper decks 1200*a* to 1200*d*. However, by enabling each feeding buffer tray to limit its functions, and enabling setting of function limitation only on a feeding buffer tray in which a problem occurs, control types may be automatically switched in such a manner that, when the number of connected printing paper decks is smaller than the number of operable feeding buffer trays free from buffering-function limitation, the image forming system enables buffering control, while, when the number of connected printing paper decks is greater, the image forming system enables non-buffering control.

Control in a Case in Which Paper Jam Occurs

Next, an operation of the image forming system in a case in which a paper jam occurs is described below.

In the image forming system, even in a case in which a paper jam occurs during the operation of the job, if the occurrence point of the jam lies between the sheet deck assembly 1200 and the feeding buffer apparatus 1300, the image forming operation can be continued until printing paper in the feeding buffer trays 1306 to 1309 in the feeding buffer apparatus 1300 is exhausted when a predetermined amount of printing paper is stored in the feeding buffer trays 1306 to 1309.

Accordingly, by providing means of indication which uses the message display portion 4001*f* in the operation unit 2307 of the feeding buffer apparatus 1300 to indicate occurrence of the paper jam and to instruct the user to perform a restoring operation, the user completes the restoring operation before the image forming system halts due to a lack of printing paper. This can prevent system halt caused by paper jam.

In addition, when a paper jam occurs in a position after the feeding buffer apparatus 1300, since the feeding buffering operation can be continuously performed, printing paper stops between the sheet deck assembly 1200 and the feeding buffer apparatus 1300, so that the printing paper does not need to be removed.

Figure 20:
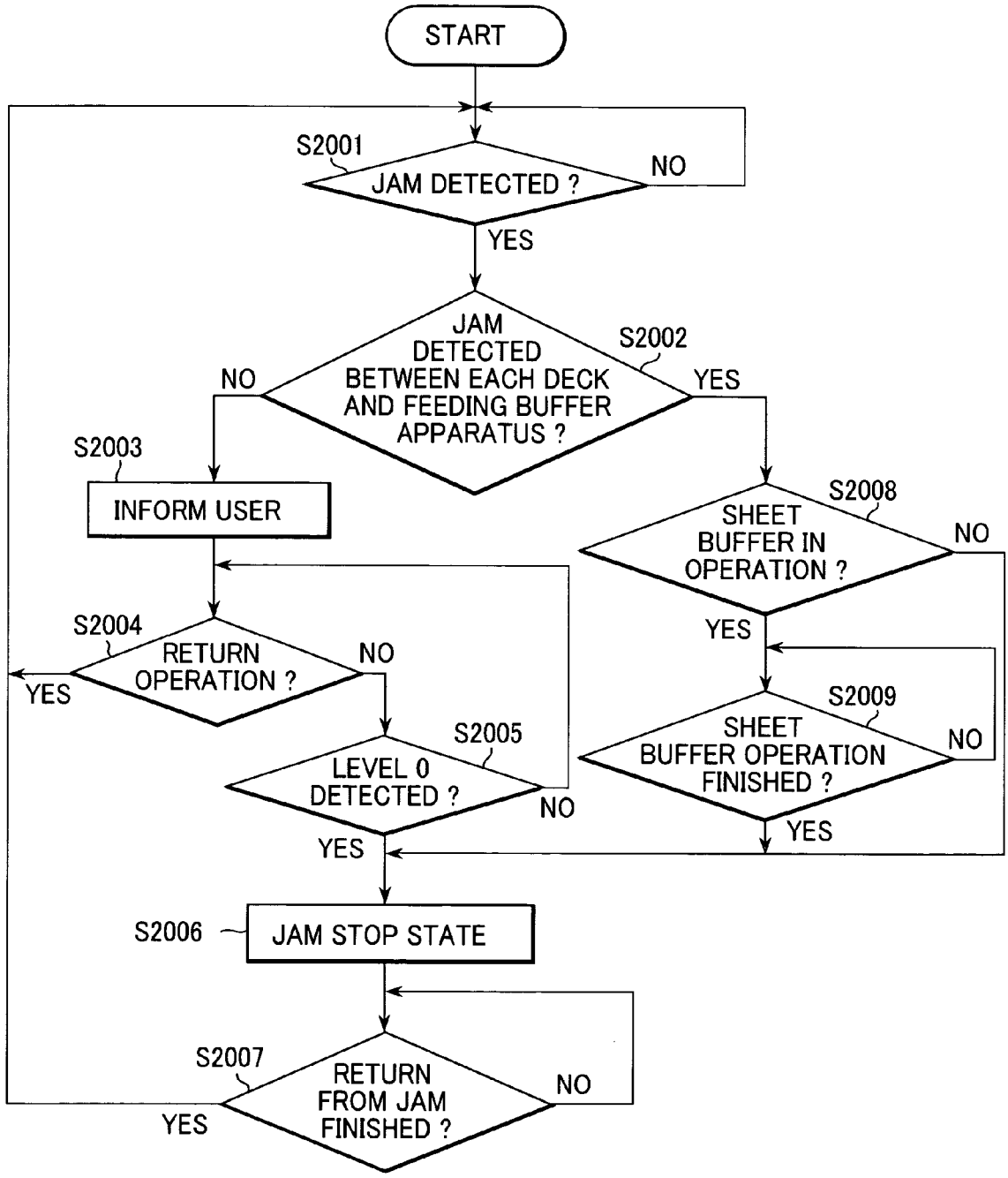
FIG. 20 is a flowchart showing an operation of the image forming system when a paper jam occurs.

The operation of the image forming system when the paper jam occurs is described below with reference to the flowchart shown in FIG. 20.

In step S2001, it is determined whether a paper jam occurs. If it is determined in step S2002 that the jam has occurred between the printing paper decks 1200*a* to 1200*d* and the feeding buffer apparatus 1300, the process proceeds to step S2003. If the jam has occurred in a position after the feeding buffer apparatus 1300, the process proceeds to step S2008.

In step S2003, the user is informed that the jam occurs between the printing paper decks 1200*a* to 1200*d* and the feeding buffer apparatus 1300, a message instructing the user to perform a restoring operation. The user performs the restoring operation in accordance with the displayed instruction. In step S2004, completion of the restoring operation is completed. If it is determined in step S2005 that Level 0 (no-paper state) is detected, the process proceeds to step S1106, and the image forming system comes into halt due to the jam. After the restoring operation finishes, the process returns to step S2001. In step S2006, the image forming system comes into halt.

In step S2007, a return from the jam state, and the process returns to step S2001. In step S2008, it is determined whether the image forming system is in the feeding buffering state. If the image forming system is not in the feeding buffering state, the process proceeds to step S2006, and the image forming system is halted due to the jam. If the image forming system is in the feeding buffering state, the process proceeds to step S2009. If it is determined in step S2009 that the feeding buffering operation finishes, the process proceeds to step S2006, and the image forming system comes into halt due to the jam. If it is determined that the image forming system is in the feeding buffering state, the process proceeds to step S2007. If the image forming system is not in the feeding buffering state, the image forming system comes into a halt. During the limitation of the feeding buffering functions, the feeding buffer assignment control and the feeding buffering control are not performed.

As described above, even if a paper jam occurs between the printing paper decks 1200*a* to 1200*d* and the feeding buffer apparatus 1300, a job can be continued until printing paper in the feeding buffer trays 1306 to 1309 runs out since the printing paper in the feeding buffer trays 1306 to 1309 can be fed. Therefore, before the printing paper in the feeding buffer trays 1306 to 1309 runs out, by using means of indication, such as a display screen of an operation unit or the like, the user is informed that a paper jam has occurred between the printing paper decks 1200*a* to 1200*d* and the feeding buffer apparatus 1300. A restoring operation from the jam-occurring state can reduce job interruption due to the jam.

Also, when a paper jam occurs in the image forming apparatus 100, even if printing paper is being fed from the printing paper decks 1200*a* to 1200*d* to the feeding buffer apparatus 1300, the feeding buffering operation can be continuously performed. This eliminates the need to remove a sheet of printing paper between a printing paper deck and the feeding buffer apparatus 1300, so that usability can be improved.

In this embodiment, the feeding buffer apparatus 1300 include the feeding buffer trays 1306 to 1309, and the feeding buffer trays 1306 to 1309 can store bundles of sheets in order of images to be formed by the image forming apparatus 100. However, the number of feeding buffer trays may be one. In this case, this one feeding buffer tray can store one or more bundles of sheets of printing paper.

Control of Feeding Printing Paper to Feeding Buffer Trays

Figure 14:
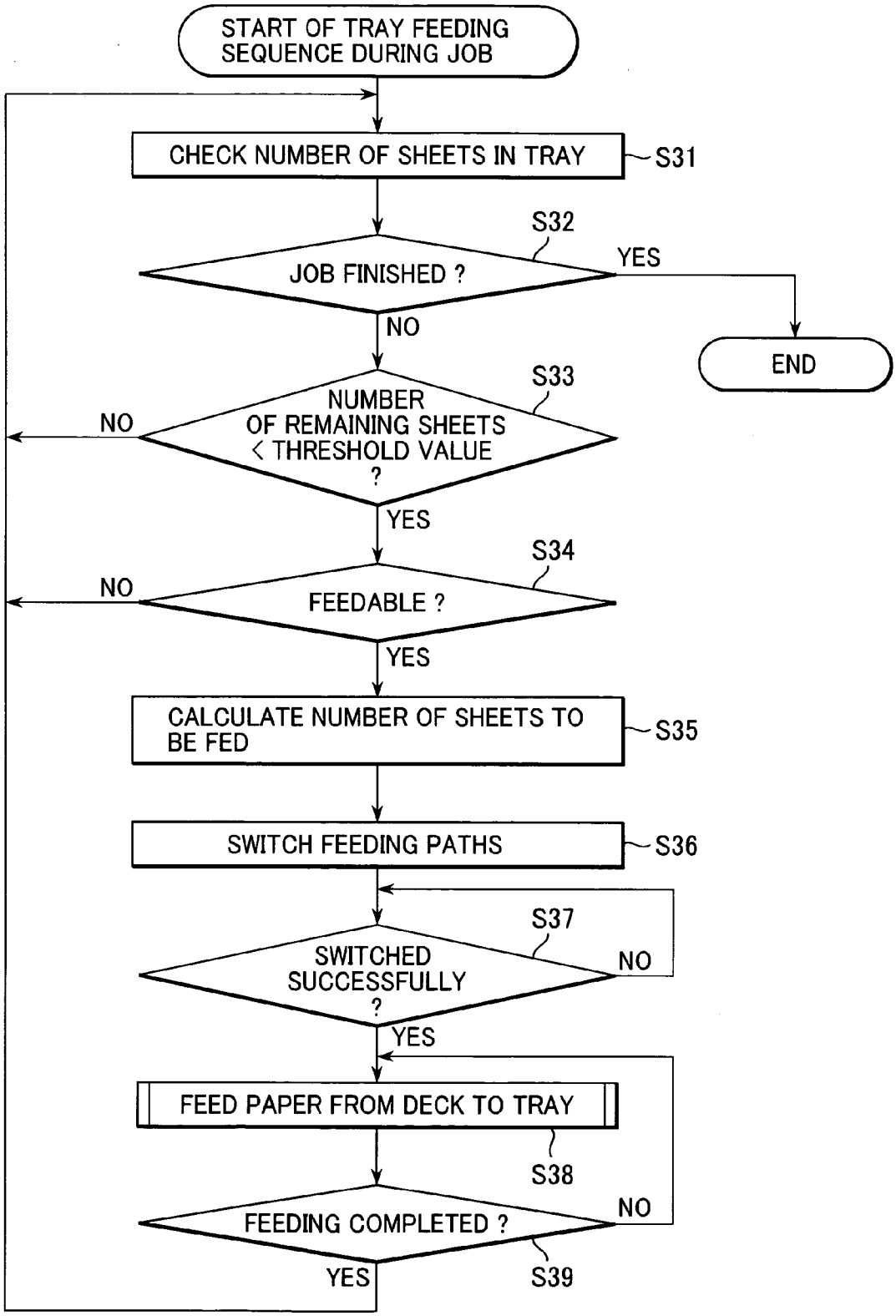
FIG. 14 is a flowchart showing a process of feeding printing paper to feeding buffer trays during the operation of a printing job.

FIG. 14 is a flowchart showing a process of feeding printing paper to the feeding buffer trays 1306 to 1309 during the operation of a printing job. As described above, during the operation of image formation, printing paper is fed from the feeding buffer trays 1306 to 1309 to the image forming apparatus 100. Accordingly, to prevent the printing paper in the feeding buffer trays 1306 to 1309 from running out, during the printing job, printing paper must be fed to the feeding buffer trays 1306 to 1309.

In step S31, the number of sheets of printing paper each feeding buffer tray is checked. If it is determined in step S32 that the job has finished, the process ends.

If it is determined in step S33 that the number of sheets of printing paper in the feeding buffer trays 1306 to 1309 is smaller than a predetermined threshold value, in step S34, it is determined whether printing paper can be fed. Regarding a situation in which paper feeding is impossible, for example, there is a case in which the feeding buffer trays 1306 to 1309 have no printing paper. If it is determined in step S33 that the number of sheets of printing paper in the feeding buffer trays 1306 to 1309 is greater than the threshold value, or if it is determined in step S34 that the printing paper cannot be fed, the process returns to step S31, and the number of sheets of printing paper in the feeding buffer trays 1306 to 1309 is checked again. Once the printing paper decks 1200*a* to 1200*d* have no printing paper, when printing paper is fed to the printing paper decks 1200*a* to 1200*d* before the printing paper in the feeding buffer trays 1306 to 1309 runs out, the job is continued. After that, it is determined that printing paper can be fed.

If it is determined in step S34 that the printing paper can be fed, in step S35, the paper feeding switching mechanism 1305 is controlled to enable paper feeding from one printing paper deck for a feeding buffer tray. In step S36, completion of the switching is confirmed. This is because, although the flowchart in FIG. 14 describes control by paying attention to a specified feeding buffer tray, the actual control feeds printing paper from a plurality of feeding buffer trays to the image forming apparatus 100, the feeding buffer trays may simultaneously feed printing paper and their rights of use of a path must be mediated.

After a paper feeding path is established in step S36, then in step S37 printing paper is fed from the printing paper deck for the feeding buffer tray. As described above, the required consecutive sheets of printing paper are not always fed to the feeding buffer tray since simultaneously required types of feeding control must be performed in balance.

In step S38, sheets of printing paper are fed until detecting a state in which the number of sheets of the printing paper reaches a maximum storage limit of the feeding buffer tray.

A state in which the number of sheets of printing paper reaches a maximum storage limit of each of the feeding buffer trays 1306 to 1309 is detected such that the CPU 2301 in the feeding buffer apparatus 1300 manages the number of sheets fed to each feeding buffer tray and the number of sheets fed from the feeding buffer tray to the image forming apparatus 100, compares the present number of sheets in the feeding buffer tray with its maximum storage value, and determines, based on the comparison, that the present number reaches the maximum storage value. In addition, based on an output from the remaining-amount detecting sensor S2 provided in each feeding buffer tray, it is determined that the present number reaches the maximum limit.

After the feeding of the printing paper to the feeding buffer tray is completed, the process returns to step S31, and the checking of the number of sheets in each of the feeding buffer trays 1306 to 1309 is restarted.

As described above, after printing paper stored in the feeding buffer trays 1306 to 1309 beforehand is fed to the image forming apparatus 100, and at the time that the remaining amount of printing paper has a predetermined value, printing paper is fed from the printing paper decks 1200*a* to 1200*d* to the feeding buffer trays 1306 to 1309 until its amount reaches a predetermined value, asynchronously with the operation of feeding to the image forming apparatus 100.

Feeding-Starting Trigger by Deck Opening and Closing

The following describes an embodiment in which the start of feeding printing paper from each printing paper deck to the feeding buffer apparatus 1300 is triggered by opening and closing of the cover of the printing paper deck.

Figure 21:
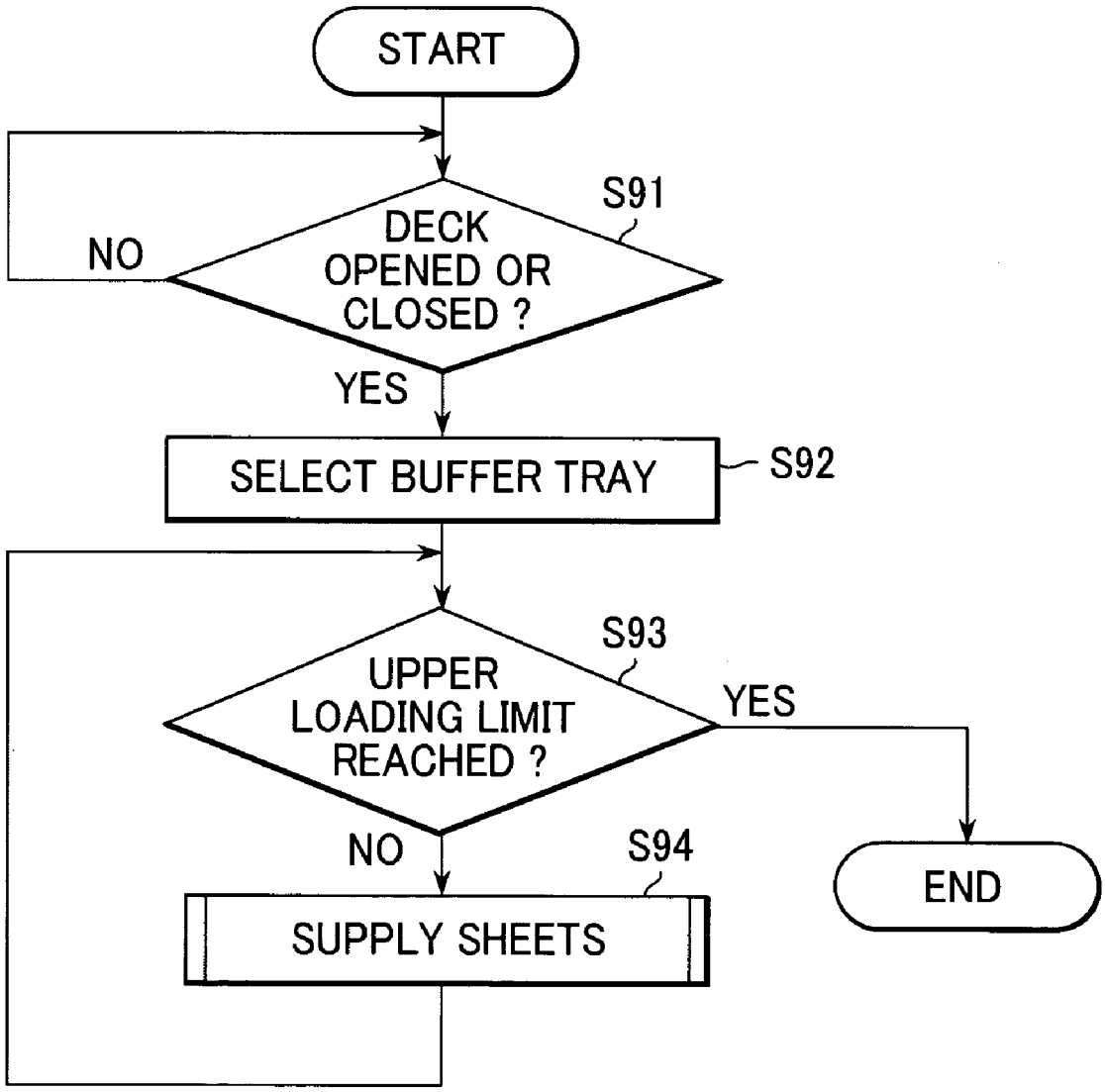
FIG. 21 is a flowchart a process of paper feeding in a case in which opening and closing of a printing-paper-deck cover trigger the start of feeding printing paper from a sheet deck assembly to a feeding buffer apparatus.

FIG. 21 is a flowchart showing a process of paper feeding in a case in which opening and closing of the deck cover trigger the start of feeding printing paper from the sheet deck assembly 1200 to the feeding buffer apparatus 1300.

In step S91, it is determined whether each of the printing paper decks 1200*a* to 1200*d* is opened and closed. When the printing paper deck is opened or closed, it is determined that the user feeds printing paper to the printing paper deck, and the process proceeds to step S92. In step S92, under the above-described feeding-buffer assignment control, for the printing paper deck which is opened or closed, a corresponding feeding buffer tray is selected.

In step S93, it is determined whether the number of sheets of printing paper in the feeding buffer tray to be fed has reached the maximum storage limit of the feeding buffer tray. If the number of sheets of printing paper in the feeding buffer tray to be fed reaches the maximum storage limit, the process ends without feeding the printing paper. If it is determined in step S93 that the number of sheets of printing paper in the feeding buffer tray to be fed does not reach the maximum storage limit, that is, the feeding buffer tray is feedable, the printing paper is fed to the feeding buffer tray, and the process returns to step S93. The described processing is repeatedly performed until it is determined in step S93 that the number of sheets of printing paper in the feeding buffer tray to be fed reaches the maximum limit. Processing in step S94 includes the step S35 and step S36 (path establishment) described with reference to FIG. 14.

Feeding-Start Trigger by Power Switch-On

Figure 22:
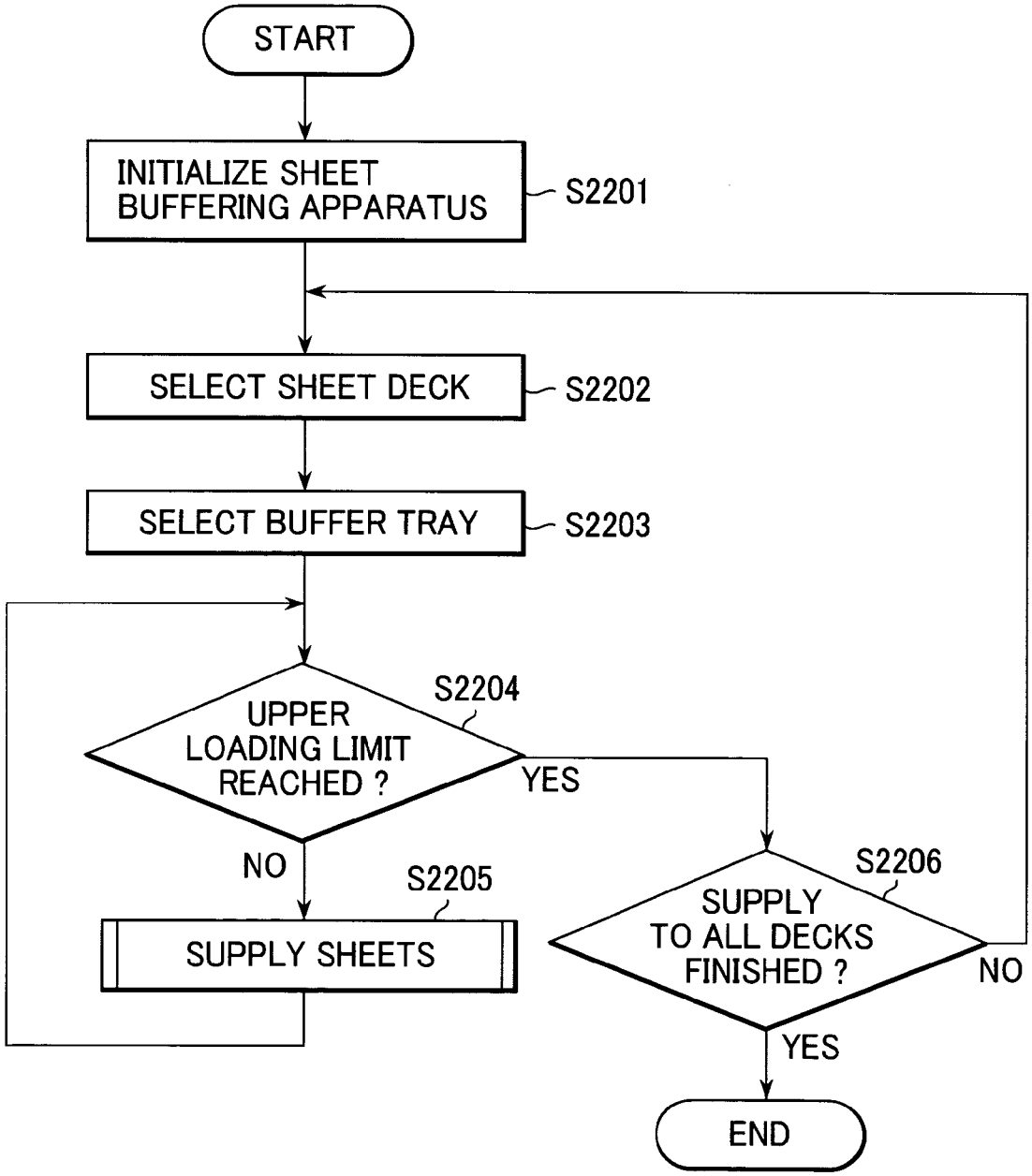
FIG. 22 is a flowchart showing a process of paper feeding in a case in which power switch-on is used as a feeding-start trigger.

FIG. 22 is a flowchart showing a process of paper feeding in a case in which power switch-on is used as another feeding-start trigger.

In step S2201, the feeding buffer apparatus 1300 is initialized when its power is switched on. In step S2202, a printing paper deck for paper feeding is selected. In step S2203, under the feeding-buffer assignment control, for the selected printing paper deck, a corresponding feeding buffer tray to be fed is selected. In step S2204, it is determined whether the amount of printing paper in the feeding buffer tray to be fed reaches the maximum storage amount. If the amount of the printing paper reaches the maximum amount, the process proceeds to step S2206 without feeding printing paper.

If it is determined in step S2204 that the feeding buffer tray is feedable, then in step S2205 printing paper is fed, and the process returns to step S2204. The described processing is repeatedly performed until it is determined in step S2204 that the amount of printing paper reaches the maximum amount.

In step S2206, it is determined whether paper feeding to all the printing paper decks 1200*a* to 1200*d* has finished. When the feeding has not finished yet, the process returns to step S2202, and the next printing paper deck is selected. If it is determined in step S2206 that the feeding to all the printing paper decks 1200*a* to 1200*d* has finished, the process ends.

Feeding-Start Trigger by Operation of Initialization Key

Figure 23:
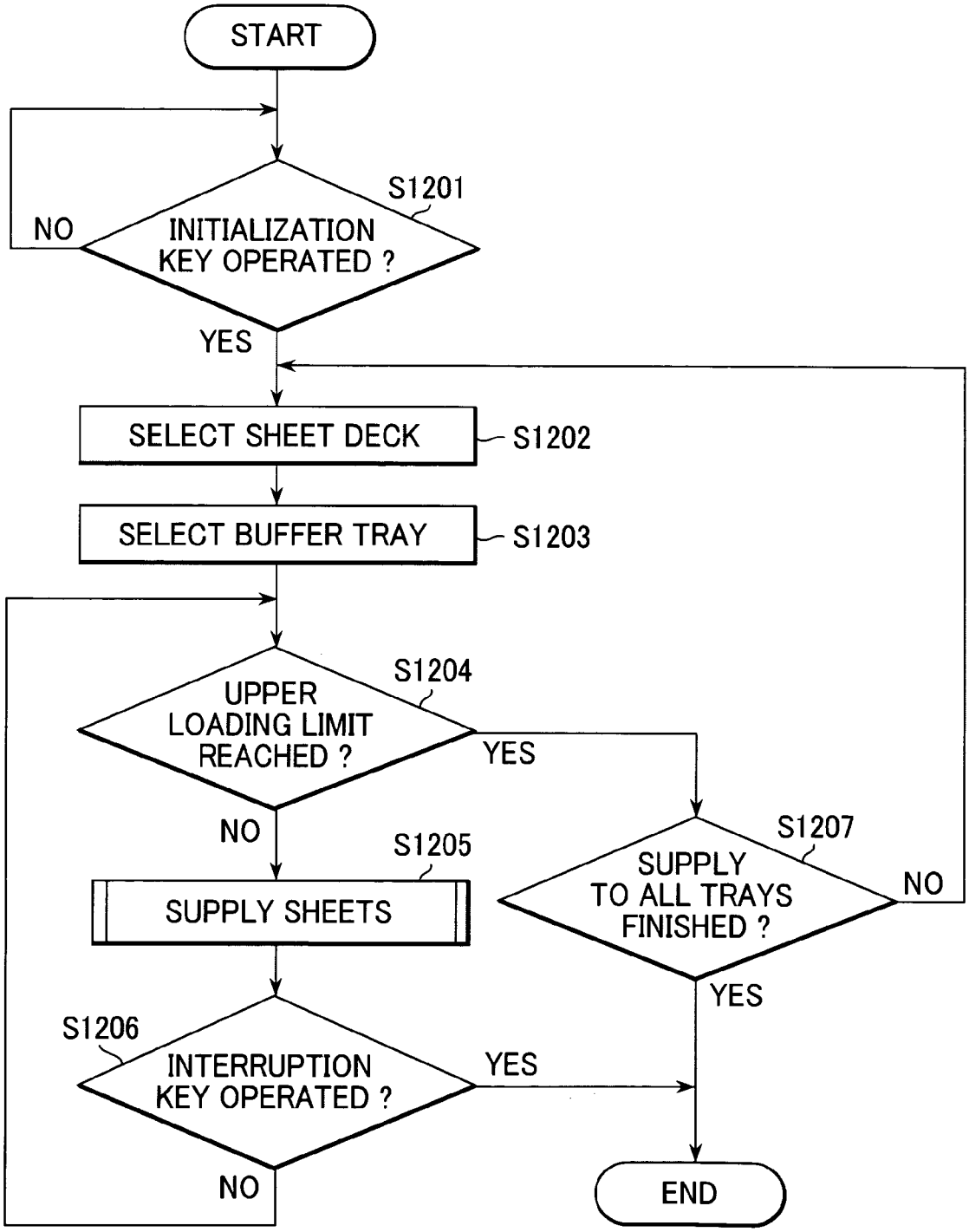
FIG. 23 is a flowchart showing a process of printing paper feeding in the case of using the operation of the initialization key 4002 (shown in FIG. 7) as a feeding-start trigger.

FIG. 23 is a flowchart showing a process of printing paper feeding from the sheet deck assembly 1200 to the feeding buffer apparatus 1300 in the case of using the operation of the initialization key 4002 in the operation unit 2307 (shown in FIG. 7) as a feeding-start trigger.

In step S1201, it is determined whether the initialization key 4002 is operated. After the initialization key 4002 is operated, then in step S1202 a printing paper deck for paper feeding is selected. In step S1204, under the feeding-buffer assignment control, for the selected printing paper deck, a corresponding feeding buffer tray to be fed is selected. In step S1204, it is determined whether the amount of printing paper in the feeding buffer tray to be fed reaches the maximum storage amount. If the amount of printing paper reaches the maximum amount, the process proceeds to step S1207 without feeding printing paper.

If it is determined in step S1204 that the feeding buffer tray is feedable, in step S1205, the feeding buffer tray is fed with printing paper. In step S1206, it is determined whether the interruption key 4003 is operated. If the interruption key 4003 is operated, the process ends. If not, the process returns to step S1204. This processing is repeatedly performed until it is determined in step S1204 that the amount of printing paper reaches the maximum amount.

In step S1207, it is determined whether printing paper feeding to the feeding buffer trays 1306 to 1309 has finished for all the printing paper decks 1200*a* to 1200*d*. If the printing paper feeding has not finished yet, the process returns to step S1202, the next printing paper deck is selected. If it is determined in step S1207 that the feeding to the feeding buffer trays 1306 to 1309 has finished for all the printing paper decks 1200*a* to 1200*d*, the process ends.

Although, in this embodiment, the initialization key 4002 is provided on the operation unit 2307 of the feeding buffer apparatus 1300, it may be provided for each of the printing paper decks 1200*a* to 1200*d*, or on the operation unit 203 of the image forming apparatus 100.

In the image forming system according to the above-described embodiment, a feeding buffer apparatus is provided which temporarily collects and stores sheets of printing paper stored in a plurality of sheet storage units, and the feeding buffer apparatus feeds the sheets to an image forming apparatus. Thus, a carrying path used for directly feeding the sheets to the image forming apparatus can be shortened, and simplified sheet-carriage control enables sheet-interval control maintaining the minimum sheet interval. Thus, a decrease in productivity can be minimized. As described above, simplified carriage control can provide a highly reliable image forming system.

Moreover, by controlling paper feeding s that printing paper is stored in order of images to be formed by the image forming apparatus before being fed to the image forming apparatus, the image forming system only needs to be controlled so that printing paper is always fed from one feeding buffer tray to the image forming apparatus. This simplifies carriage control and produces high reliability.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims.

What is claimed is:

1. An image forming system comprising:

an image forming apparatus which forms an image on a sheet;

a plurality of sheet storage units each of which store sheets to be fed to said image forming apparatus; and a temporary storage apparatus comprising:

a plurality of temporary storage trays for temporarily storing sheets supplied from the sheet storage units; and a feeding unit for feeding the sheets stored in the temporary storage trays to said image forming apparatus.

2. The image forming system according to claim 1, wherein the sheets stored in said plurality of sheet storage units are temporarily stored in one of said plurality of temporary storage trays in an order corresponding to images to be formed by said image forming apparatus, before being fed to said image forming apparatus.

3. The image forming system according to claim 1, wherein the image forming system further comprises a direct path from said plurality of sheet storage units to said image forming apparatus, said direct path separate from the temporary storage trays.

4. The image forming system according to claim 3, further comprising a horizontal carriage path common to the sheet storage units, wherein:

the sheet storage units are horizontally and collinearly disposed;

the horizontal carriage path carries sheets fed from each of the horizontally and collinearly disposed sheet storage units; and the horizontal carriage path is connected to the direct path.

5. The image forming system according to claim 3, further comprising control means for controlling sheet feeding so that, when the temporary storage trays are unable to store sheets, the direct path is used to carry the sheets to said image forming apparatus.

6. The image forming system according to claim 3, further comprising control means for controlling sheet feeding so that a first sheet in a job is fed to said image forming apparatus through the direct path without being stored in any one of the temporary storage trays, and so that the second and subsequent sheets are temporarily stored in the temporary storage trays before being fed from the temporary storage trays to said image forming apparatus.

7. The image forming system according to claim 3, further comprising control means for controlling sheet feeding so that, in a first job, sheets are fed to said image forming apparatus through the direct path without being stored in the temporary storage trays, and so that in the second and subsequent jobs, sheets are temporarily stored in the temporary storage trays before being fed from the temporary storage trays to said image forming apparatus.

8. The image forming system according to claim 1, further comprising control means for asynchronously performing an operation of supplying the sheets from the sheet storage units to the temporary storage trays, and for controlling an operation of feeding the sheets from the temporary storage units to said image forming apparatus.

9. The image forming system according to claim 1, wherein a number of temporary storage trays is at least equal to a maximum number of sheet storage units connected to said image forming apparatus from among said plurality of sheet storage units.

10. The image forming system according to claim 1, wherein a direction in which sheets are supplied from the sheet storage units to the temporary storage trays is substantially identical to a direction in which the stored sheets are carried to said image forming apparatus.

11. The image forming system according to claim 1, further comprising:

assignment control means for assigning one of the temporary storage trays for storing the sheets fed from the sheet storage units; and control means for controlling sheet storage so that the sheets carried from each of the sheet storage units are temporarily stored in the assigned temporary storage tray.

12. The image forming system according to claim 1, further comprising:

a sheet carrying path between the plurality of sheet storage units and said temporary storage apparatus; and control means for controlling sheet conveyance so that when a sheet jam occurs on the sheet carry path, sheet supplying from the sheet storage units to said temporary storage apparatus is stopped and sheet feeding from said temporary storage apparatus to said image forming apparatus is continued.

13. The image forming system according to claim 12, further comprising indicating means for indicating that the sheet supplying operation to said temporary storage apparatus has been interrupted when the sheet jam occurs on the sheet carrying path between the sheet storage units and said temporary storage apparatus.

14. The image forming system according to claim 12, wherein said control means controls conveyance so that when a sheet jam occurs in said image forming apparatus, the sheet feeding operation from said temporary storage apparatus to said image forming apparatus is stopped and the sheet supplying operation from the sheet storage units to said temporary storage apparatus is continued.

15. The image forming system according to claim 1, further comprising sheet detecting means for detecting sheet stored in the sheet storage units and the temporary storage trays, wherein even if the sheet detecting means detects a lack of sheets in the sheet storage units, the sheet feeding operation from the temporary storage trays is continued until the sheets stored in the temporary storage units run out.

16. The image forming system according to claim 15, further comprising indicating means for indicating an inability to perform the sheet supplying operation to said temporary storage apparatus in response a lack of sheets stored in the temporary storage units.

17. The image forming system according to claim 1, further comprising trigger means for generating a trigger signal for initiating sheet supplying from the sheet storage units to the temporary storage trays.

18. The image forming system according to claim 17, wherein each of said storage units has a sheet loading cover and said trigger means generates the trigger signal in response to detection of opening and closing of the sheet loading cover of each of the sheet storage units.

19. The image forming system according to claim 1, wherein said trigger means generates the trigger signal in response to a detection of a power switch-on of the image forming system.

20. The image forming system according to claim 1, wherein the temporary storage units are of a size sufficient to store the number of sheets required for a given job.

21. The image forming system according to claim 1, further comprising control means for controlling sheet feeding in a first mode in which the sheets stored in the sheet storage units are stored in the temporary storage trays in said temporary storage apparatus before being fed to said image forming apparatus, and a second mode in which the sheets stored in the sheet storage units are fed to said image forming apparatus without being stored in the temporary storage trays, wherein said control means controls the sheet feeding to be in the second mode for a normal job requiring higher productivity and controls the sheet feeding to be in the first mode for a job in which a lower productivity of said image forming apparatus is needed as compared with the normal job.

* * * * *

UNITED STATES PATENT AND TRADEMARK OFFICE

CERTIFICATE OF CORRECTION

PATENT NO. : 7,050,751 B2
APPLICATION NO. : 10/890109
DATED : May 23, 2006
INVENTOR(S) : Naoto Watanabe et al.

It is certified that error appears in the above-identified patent and that said Letters Patent is hereby corrected as shown below:

DRAWING SHEET NO. 7 of 25:
Figure 7, “LIMITTING” should read --LIMITING--.

DRAWING SHEET NO. 13 of 25:
Figure 13, “TARY PATHS” should read --TRAY PATHS--.

DRAWING SHEET NO. 19 of 25:
Figure 19, “COPYIG” should read --COPYING--.

COLUMN 1:
Line 30, “in the” should read --in--.

COLUMN 2:
Line 53, “store” should read --stores--.

COLUMN 4:
Line 31, “flowchart” should read --flowchart showing--.

COLUMN 10:
Line 65, “only” should be deleted.

COLUMN 14:
Line 7, “display” (second occurrence) should read --displays--.

COLUMN 15:
Line 11, “Buffer-” should read --buffer- --.
Line 36, “¶ Printing” should read --Printing--.

COLUMN 17:
Line 10, “paper” should read --paper is--.
Line 63, “amount. the” should read --amount. The--.

COLUMN 19:
Line 33, “continued” should read --continues--.
Line 52, “number” should read --number of--.

COLUMN 24:
Line 24, “detects” should read --detect--.

UNITED STATES PATENT AND TRADEMARK OFFICE

CERTIFICATE OF CORRECTION

PATENT NO. : 7,050,751 B2
APPLICATION NO. : 10/890109
DATED : May 23, 2006
INVENTOR(S) : Naoto Watanabe et al.

It is certified that error appears in the above-identified patent and that said Letters Patent is hereby corrected as shown below:

COLUMN 27:
Line 22, "a message" should read --in a message--.
Line 32, in step S2007" should read --step S2007 marks--

COLUMN 28:
Line 22, "feeding" should read --feeding a--.

COLUMN 30:
Line 46, "S1202," should read --S1202, and--.

COLUMN 31:
Line 1, "s that" should read --so that--.
Line 19, "store" should read --stores--.

COLUMN 32:
Line 64, "response" should read --response to--.

Signed and Sealed this

Twenty-second Day of May, 2007

JON W. DUDAS
*Director of the United States Patent and Trademark Office*